US010035158B2

(12) United States Patent
Kang

(10) Patent No.: US 10,035,158 B2
(45) Date of Patent: Jul. 31, 2018

(54) CONTENTS DISPENSING PUMP

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 73 days.

(21) Appl. No.: 15/036,156

(22) PCT Filed: Nov. 12, 2014

(86) PCT No.: PCT/KR2014/010828

§ 371 (c)(1),
(2) Date: May 12, 2016

(87) PCT Pub. No.: WO2015/072732

PCT Pub. Date: May 21, 2015

(65) Prior Publication Data

US 2016/0303602 A1 Oct. 20, 2016

(30) Foreign Application Priority Data

Nov. 13, 2013 (KR) ..... 10-2013-0137515

(51) Int. Cl.
*B05B 11/00* (2006.01)

(52) U.S. Cl.
CPC ..... *B05B 11/3028* (2013.01); *B05B 11/004* (2013.01); *B05B 11/3001* (2013.01);
(Continued)

(58) Field of Classification Search
CPC ..... B05B 11/3035; B05B 11/0048; B05B 11/3028; B05B 11/3069; B05B 11/3033;
(Continued)

(56) References Cited

U.S. PATENT DOCUMENTS 4,946,076 A * 8/1990 Hackmann ..... B05B 11/0048 222/207
5,894,960 A * 4/1999 Rodden, Jr. ..... B05B 11/303 222/207

(Continued)

FOREIGN PATENT DOCUMENTS

JP 09-225361 A 9/1997
JP 2010-047295 A 3/2010

(Continued)

*Primary Examiner* — Charles P Cheyney
(74) *Attorney, Agent, or Firm* — Heedong Chae; Lucem, PC

(57) ABSTRACT

The present invention relates to a contents dispensing pump which is coupled to a container (V) for accommodating the contents therein and dispenses the contents, comprising: a pump main body (10); a pump upper body (20); a pump inner body (30); a dispensing valve (40); and an elastic member (50). The pump upper body (20) is coupled to the upper side of the pump main body (10) so that a pumping operation is made by an up and down movement with respect to the pump main body (10). The pump inner body (30) has a bowl shape with the middle thereof formed to be dented so that an inlet valve plate (70) is integrally formed on the lower surface. The dispensing valve (40) is coupled to the upward side of the pump upper body (20), and has, formed therein, a valve protrusion wheel (41) for opening and closing the content outlet (23). The elastic member (50) is positioned between the upper lateral surface extension piece (33) and the lower lateral surface extension piece (34) of the pump inner body (30) so as to draw the pump inner body (30) and simultaneously elastically support the pump main body (10) and the pump upper body (20).

17 Claims, 24 Drawing Sheets

(52) U.S. Cl.
CPC ..... *B05B 11/3025* (2013.01); *B05B 11/3046* (2013.01); *B05B 11/3077* (2013.01); *B05B 11/3078* (2013.01)

(58) Field of Classification Search
CPC ..... B05B 11/3074; B05B 11/3077; B05B 11/004; B05B 11/3001; B05B 11/3025; B05B 11/3046; B05B 11/3078
USPC ..... 222/207, 209, 256, 321.7, 321.9
See application file for complete search history.

(56) References Cited

U.S. PATENT DOCUMENTS

| | | | | |
|---|---|---|---|---|
| 6,712,243 | B2 * | 3/2004 | Rossignol | B05B 11/0051 222/207 |
| 7,677,415 | B2 * | 3/2010 | Auer | B05B 11/3035 222/207 |
| 8,240,516 | B2 * | 8/2012 | Lautre | B05B 11/0029 222/153.13 |
| 2014/0239017 | A1 * | 8/2014 | Von Schuckmann | B05B 11/0048 222/207 |
| 2016/0332180 | A1 * | 11/2016 | Bruder | B05B 11/3033 |

FOREIGN PATENT DOCUMENTS

| | | | |
|---|---|---|---|
| KR | 10-2009-0048727 | A | 5/2009 |
| KR | 10-2010-0128968 | A | 12/2010 |
| KR | 20-2011-0007033 | U | 7/2011 |

* cited by examiner

CONTENTS DISPENSING PUMP

CROSS-REFERENCE TO RELATED APPLICATION

This application claims the benefit of Korean Application No. 10-2013-0137515, filed on Nov. 13, 2013 with the Korean Intellectual Property Office, the disclosure of which is incorporated herein by reference.

TECHNICAL FIELD

The present invention relates to a contents dispensing pump which is mounted on a container so as to dispense, to an outside, contents contained in the container by a fixed quantity through a pumping operation and use the contents, and more particularly, to a contents dispensing pump which increases productivity and lowers the product price due to a simple structure of the contents dispensing pump configured in such a manner that a pump upper body is inserted onto the upper portion of a pump main body, a pump inner body is inserted on the inside of the pump upper body and the pump main body, a valve protrusion wheel of a dispensing valve is coupled to a dispensing protrusion rod of the upper portion of the pump upper body so that the pump upper body is made to move up and down with respect to the pump main body end thus the volume in a contents temporary reservoir of the pump inner body is changed, thereby allowing the contents to be dispensed, and at the same time, can be easily mounted even in a product having a small space in which the dispensing pump is to be mounted, by performing a pumping operation by changing the volume of the temporary contents reservoir due to a deformation of the pump inner body such that a stroke distance of the dispensing pump can be short as in a gel type foundation container of a compact type.

BACKGROUND ART

In general, as one means for dispensing a suitable amount of contents, such as cosmetics, shampoo, or detergent, contained in a container, a dispensing pump is mounted on a container for use.

The dispensing pumps according to the related art, which are mounted on a container and used to dispense a small amount of contents as described above, have been variously proposed. As shown in FIGS. 1 and 2, a general contents dispensing pump includes a pump body 110 in which an opening and closing ball 122, an operating piston 123 elastically supported by a spring, and a cylinder 120 for allowing the contents in a contents storing chamber 126 to foe dispensed through a push button 140 by generating pressure in the contents storing chamber 126 with the operating piston 123 are installed.

An air-tight piston 124 is further installed to the operating piston 123 and the push button 140 is installed in an operating tube 130 coupled to the operating piston 123 of the cylinder 120.

According to the above-described contents dispensing pump of the related art, when the push button 140 is pushed, an air gap is generated between the air-tight piston 124 and the operating piston 123. In this case, a pressure is generated in the contents storing chamber 126 while the air-tight piston 124 and the operating piston 123 together move down, so that the contents are dispensed through a contents transferring passage 123*a* of the operating piston 123 due to the pressure.

In this case, the opening and closing ball 122 is tightly closed to a contents introducing passage 125 by the compressed spring 121 so that the contents introducing passage 125 is closed.

After the push button 140 is pushed to dispense contents as described above, when the pushed button 140 is released from the external force applied thereto, as shown in FIG. 2, the operating piston 123 and the air-tight piston 124 may move up together due to the repulsive elastic force accumulated in the spring 121.

At the initial lifting stage of the operating piston 123 and the air-tight piston 124 ascending as described above, while the air-tight piston 124 is stooped ascending due to the friction with an inside of the cylinder 120, the operating piston 123 first moves up to close the air gap between the operating piston 123 and the air-tight piston 124, so that the contents transferring passage 123*a* is closed.

In the state that the contents transferring passage 123*a* is shut off, when the operating piston 123 and the air-tight piston 124 are continuously lifted up, a vacuum pressure is generated in the contents storing chamber 125 and the opening and closing ball 122 is spaced apart from the contents introducing hole 125 due to the vacuum pressure generated in the contents storing chamber 126, so that the contents in the container are introduced into the contents storing chamber 126.

The contents dispensing pump according to the related art dispenses the contents while repeatedly performing the above-described operation.

However, the contents dispensing pump has a major drawback that, since a metallic ball and metallic spring are used as the opening and closing means for dispensing contents, the metallic ball and metallic spring are corroded due to chemical reaction with the contents so that the contents are polluted. In addition, since synthetic resin and metal are used as materials of the contents dispensing pump, when the used contents dispensing pump is discarded, it is difficult to separate the synthetic resin and metallic materials from each other, so that it is difficult to perform resource recycling.

Specifically, the structure of the contents dispensing pump according to the related art is complex, so that the productivity is deteriorated and the product price is increased. In addition, since the dispensing pump structurally has a long working stroke distance, when the dispensing pump is applied to a product such as a compact having a height less than a width thereof, it is difficult to mounting the dispensing pump on the product due to a small mounting space.

To solve the problem, as shown in FIGS. 3 to 5, there has been disclosed to a contents dispensing pump having a simple structure in Korean Patent Application No. 10-2013-0063816 applied by the same applicant as that of the present application, wherein the contents dispensing pump can allow a deformed pressing member 260 to serve as a cylinder and an opening and closing valve to simplify a structure of the contents dispensing pump so that the productivity is improved and the product price is lowered, and at the same time, be easily mounted on a product having a small space in which the dispensing pump is to be mounted, by performing a pumping operation by changing the volume of a temporary contents reservoir TR due to a deformation of the deformed pressing member 260 such that a working stroke distance of the dispensing pump can be short.

To this end, the present invention provides a contents dispensing pump which is coupled to a container 210 for containing the contents therein to dispense the contents, wherein a deformed pressing member 260 descends by being pressed and deformed when a push button 250 descends such that the volume of a temporary reservoir TR in a pump main body 220 including a pump upper body 222 and a pump lower body 224 is reduced and pressure is generated in the temporary reservoir TB. Thus, a valve plate 240 closes a contents inlet 226, and a valve protrusion wheel 262 coming into close contact with a contents opening and closing piece 252 is widened by the pressure such that the contents contained in the temporary reservoir (TR) are dispensed through an outlet 254 while passing through a gap between the contents opening and closing piece 252 and the valve protrusion wheel 262.

Then, when the pressure that presses the push button 250 is removed, while the push button 250 lifts up by a restoring force of an elastic member 270, the deformed pressing member 260 pressed by the push button 250 is restored to the original state. Thus, the pressure generated within the temporary reservoir TR disappears and vacuum pressure is generated, so that the gap between the contents opening and closing piece 252 and the valve protrusional wheel 262 of the deformed pressing member 260 is closed and the central part of the valve plate 240 is lifted by the vacuum pressure to widen boundary lines of opening and closing lines 241. Thus, the contents contained in the container 210 move to the temporary reservoir TR through a gap between the valve plate 240 and the contents outlet 242, and in this case, the contents that have passed through the contents outlet 242 move to the temporary reservoir TR through gaps of the widened opening and closing lines 241 of the valve plate 240. When the contents are transferred so that the vacuum pressure of the temporary reservoir TR disappears, the opening and closing line 241 opened due to the autonomous elastic force is restored into the original state to foe closed so that the valve plate (40) closes the contents outlet 242.

However, according to the dispensing pump, the volume of the temporary reservoir TR is changed by deforming the deformation 260 to discharge the contents according to the pressure of the temporary reservoir TR. Although the contents in the temporary reservoir TR must be discharged while the valve protrusion wheel 262 of the deformed pressing member 260 is opened when the pressure of the temporary reservoir TR is increased, since the whole deformation pressing member 260 is formed of a soft rubber material having excellent elasticity, another part of the deformation pressing member 260 is billowed before the valve protrusion wheel 262 is opened so that it is difficult to dispense a constant amount of contents all the time.

To solve the problem, as shown in FIGS. 6 to 8, there has been disclosed to a contents dispensing pump in Korean Patent Application No. 10-2013-0083084 applied by the same applicant as that of the present application, wherein a pump upper body is inserted into an upper inside of a pump main body and a valve protruding wheel of a discharge valve is inserted into an extension protrusion wheel of an upper portion of the pump upper body to discharge contents according to the vertical movement of the pump upper body moves up in a pump main body, so that the structure is simple, thereby increasing productivity and reducing the product price. In addition, the pumping is performed by varying the volume of a content temporary repository according to the vertical movement of the pump upper body in the pump main body, so that the pump for discharging contents has a short working stroke distance, thereby allowing the pump to be easily installed in a product having a small pump installing space.

According to the pump for discharging contents which is coupled to a container V for containing the contents to discharge the contents, the pump includes a suction valve plate (340) which closes a content inlet 332 as a volume of a temporary repository TR in a pump main body 310 is reduced and pressure is generated in the temporary repository TR when a pump upper body 320 moves down by pressing an upper surface of a pump upper body 320 or a discharge valve 150, and a valve protrusion wheel 352 in tight contact with a content outlet 322 of an extension protrusion wheel 326, wherein the valve protrusion wheel 352 is widened due to the pressure such that the contents in the temporary repository TR pass thorough the widened gap between the content outlet 322 and the valve protrusion wheel 352, and then, after passing through a flow path 324 which is a gap between the pump upper body 320 and the discharge valve 350, the contents are discharged through a gap which is created between an upper surface of the pump upper body 320 and an upper peripheral part of the discharge valve 350 as discharge pressure is applied to the upper peripheral part of the discharge valve 350.

When the pressure on the upper surface of the discharge valve 350 or the pump upper body 320 is removed, the pump upper body 320 moves up by restoring force of an elastic member 360 and a space of the temporary repository TR in the pump main body 310 is increased, so that vacuum pressure is generated and the gap between the valve protruding ring 352 of the discharge valve 330 and the content outlet 322 is closed. As boundaries of opening/closing lines 341 are widened while a central part of the suction valve plate 340 is raised upward due to the vacuum pressure, the contents in a container V are transferred to the temporary repository TR through a space between the suction valve plate 340 and the content inlet 320. In addition, when the contents are transferred so that the vacuum pressure in the temporary repository TR disappears, the widened opening/closing lines 341 are restored to an original state thereof and closed due to elastic force of the suction valve plate 340, so that the suction valve plate 340 closes the content inlet 332.

However, according to the contents dispensing pump, the volume of the temporary reservoir TR in the pump main body 310 is changed by allowing the pump upper body 320 inserted into the pump main body 310 to slide such that the volume of the temporary reservoir TR is changed, thereby discharging contents. Thus, according to the dispensing pump, the pump main body 310 serves as a cylinder and the pump upper body 320 serves as a piston, the friction between the pump main body 310 and the pump upper body 320 is increased so that the dispensing pump is not smoothly operated and large force is required to operating the dispensing pump, so it is inconvenient to operate the dispensing pump. In addition, due to the friction between the pump main body 310 and the pump tipper body 320, the abrasion becomes severe so that an abnormal phenomenon may occur in use.

DISCLOSURE

Technical Problem

To solve the problems described above, an object of the present invention is to provide a contents dispensing pump including a pump main body and a pump upper body which are separated from each other and formed of a hard material, where an pump inner body is coupled to insides of the pump main body and the pump upper body, so that, when contents are dispensed by changing a volume of the content temporary reservoir while the pump upper body moves up or down with respect to the pump main body, the volume of the content temporary reservoir is changed by deforming the pump inner body. So, the components are prevented from being worn due to the friction between the pump main body and the pump upper body so that the product defective is prevented, thereby improving the reliability.

Another object of the present invention is to provide a contents dispensing pump which has a simple structure to be easily manufactured so that the productivity is improved and the product price is reduced.

Still another object of the present invention is to provide a contents dispensing pump including a pump inner body and a dispensing valve separated from each other which are formed of mutually different materials to prevent the pump inner body from being billowed before the dispensing valve is operated, so that a constant amount of contents can be dispensed all the time.

Still another object of the present invention is to provide a contents dispensing pump, in which components constituting the contents dispensing pump are formed of an elastic material such as rubber or synthetic resin durable to a chemical material to be prevented from being corroded due to the contents, and any valve means formed of a metallic material are not used in the contents dispensing pump so that the used contents dispensing pump can be recycled.

Still another object of the present invention is to provide a contents dispensing pump of which a working stroke distance is shortened so that the contents dispensing pump can be easily applied to a product such as a compact having a height less than a width thereof.

Technical Solution

To achieve the objects, according to the present invention, there is provided a contents dispensing pump including a pump main body (10), a pump upper body (20), a pump inner body (30), a dispensing valve (40) and an elastic member (50).

The pump main body (10) has a bowl shape with the middle thereof formed to be dented so that a contents inlet (12) is formed in the center of a main body lower plate (11), an inlet ring-type protrusion part (13) being formed on the outer side of the content inlet (12), and a pump inner body latching sill (14) is formed in the inner side surface so as to be coupled to the pump inner body (30). In addition, a pump upper body latching protrusion wheel (15) provided on an outer upper end of the pump main body (10) to prevent the pump upper body (20) from being separated.

The pump upper body (20) is coupled to an upper portion of the pump main body (10) such that the pump upper body (20) moves up or down with respect to the pump main body (10), thereby performing a pumping operation. The pump upper body (20) is provided on a central part of an upper body upper plate (21) with a concaved dispensing valve coupling space (22). A dispensing protrusion rod (24) having a content outlet (23) is formed in the center of the dispensing valve coupling space (22). A dispensing valve coupling sill (25), to which a dispensing valve (40) is coupled, is formed in the side wall surface of the dispensing valve coupling space (22). A first coupling extension piece (28) coupled to the pump inner body (30) and a second coupling extension piece (29) spaced apart from the first coupling extension piece (28) by a predetermined interval are formed below the upper body upper plate (21). The second coupling extension piece (29) is formed at an outer side than the first coupling extension piece (28). In addition, an upper extension piece (26) formed below an outer end of the pump upper body (20) and a pump main body latching protrusion wheel (27) formed on an inner end of the upper body extension piece (26) to latch the pump upper body (20) to the pump upper latching protrusion wheel (15) of the pump main body (10).

The pump inner body (30) has a bowl shape with the middle thereof formed to be dented. A suction valve plate (70) is integrally formed on a bottom surface of the pump inner body (30) and a corrugate tube (31) is formed below a side surface of the pump inner body (30). A pump upper body coupling piece (32) coupled to the pump upper body (20) is formed on an upper portion of the pump inner body (30). An upper side surface extension piece (33) extends from at an outside of an upper end of the pump upper body coupling piece (32) so that the upper side surface extension piece (33) is integrally formed at the outside of the upper end of the pump upper body coupling piece (32). A lower side surface extension piece 34 extends from an outside of a lower end of the corrugate tube (31) so that the lower side surface extension piece (34) is integrally formed at the outside of the lower end of the corrugate tube (31). A lower end of the pump upper body coupling piece (32) and an upper end of the corrugate tube (31) are integrally connected to the horizontal connection piece (35) such that a lower end of the first coupling extension piece (28) of the pump upper body (20) is pressed.

The suction valve plate (70) constituting the bottom surface of the pump inner body (30) is provided at a center thereof with a valve plate (71) which covers the content inlet (12). A valve plate ring-type protrusion (72), which makes contact with the inlet ring-type protrusion part (13) of the pump main body (10) while being offset from the inlet ring-type protrusion part (13), is formed below an outside of the valve plate (71) to prevent contents from flowing therethrough, and an elastic piece (73) which is integrally connected to an outer surface of the valve plate (71) and an inner lower end of the pump inner body (30) is formed.

The dispensing valve (40) is coupled to an upper side of the pump tapper body (20) and comprises a valve protrusion wheel (41) for opening or closing the content outlet (23) of the pump upper body (20). The dispensing valve (40) is provided at an outside of the valve protrusion wheel (41) with the coupling protrusion wheel (42) coupled to the pump upper body (20). A space unit (43) which is formed between the valve protrusion wheel (41) and the coupling protrusion wheel (42) and enables the valve protrusion wheel (41) to move when the valve protrusion wheel (41) is turned on or off. The dispensing valve (40) is integrally provided on an outer end thereof with a sealing piece (44) which makes contact with an upper body upper plate (21) of the pump upper body (20) and is opened to dispense contents when being pushed by a dispensing pressure. In addition, the coupling protrusion wheel (42) may be provided on an outer side surface thereof with a fitting groove (45) into which a coupling auxiliary member (60) is fitted.

The elastic member (50) is positioned between the upper lateral surface extension piece (33) and the lower lateral surface extension piece (34) of the pump inner body (30) so as to draw the pump inner body (30) and simultaneously elastically support the pump main body (10) and the pump upper body (20).

When the dispensing valve (40) is coupled to the pump upper body (20), the coupling auxiliary member (60) may be used as a coupling auxiliary unit and the dispensing valve (40) may be directly coupled to the pump upper body (20) without using the coupling auxiliary member (60). In the embodiment, it will be described that the dispensing valve (40) is coupled to the pump upper body (20) by using the coupling auxiliary member (60). The coupling auxiliary member (60) has a cylindrical shape and is provided on an inner side surface thereof with a fitting protrusion (61) coupled into the fitting groove (45) of the dispensing valve (40). In addition, the coupling auxiliary member (60) is provided on an outer surface thereof with a pump upper body coupling sill (62) coupled to the dispensing valve coupling sill (25) of the pump upper body (20).

According to the contents dispensing pump of an embodiment of the present invention configured above, when an upper surface of a pump upper body (20) or a dispensing valve (40) is pushed to allow the pump upper body (20) to move down with respect to a pump main body (10), a corrugate tube (31) of a pump inner body (30) is inwardly folded while an elastic member (50) is compressed such that a volume of a content temporary reservoir (TR) is reduced to generate a discharge pressure in the content temporary reservoir (TR). When the contents in the content temporary reservoir (TR) are pressed to be output through a content outlet (23), a valve protrusion wheel (41) coining into close contact with the content outlet (23) is widened by the discharge pressure such that the contents are dispensed through a gap between the content outlet (23) and the valve protrusion wheel (41). Thus, after the contents pass through a path (46) which is a gap between the pump upper body (20) and the dispensing valve (40), a dispensing pressure is applied to the sealing piece (44) on the upper periphery portion of the dispensing valve (40), so that the contents are dispensed through the gap while the sealing piece (44) is opened. In this case, while the suction valve plate (70) is pushed by the pressure of the content temporary reservoir (TR), the valve plate ring-type protrusion (72) presses the inlet ring-type protrusion part (13) of the pump main body (10) so that the content inlet (12) is closed.

In addition, when the pressure on the upper surface of the dispensing valve (40) or the pump upper body (20) is removed, while the pump upper body (20) moves up by restoring force of an elastic member (50), the upper side surface extension piece extension (33) moves up together so that the corrugate tube (31) is unfolded. Thus, since the volume of the content temporary repository (TR) is increased, the vacuum pressure in the content temporary repository (TR) is generated so that the valve protrusion wheel (41) of the dispensing valve (40) closes the content outlet (22). When the valve plate (71) of the suction valve plate (70) is raised upward due to the vacuum pressure, while the valve plate ring-type protrusion (72) is spaced apart from the inlet ring-type protrusion part (13), the content inlet (12) is opened so that the contents in the container (V) are transferred to the content temporary repository (TR). As the contents are transferred to the content temporary repository (TR), the vacuum pressure in the temporary repository (TR) disappears and the valve plate (71) is restored to an original state thereof and closed due to elasticity of the elastic piece (73) of the auction valve plate (70), so that the content inlet (12) is closed.

Advantageous Effects

According to the present invention, there is provided the contents dispensing pump including a pump main body aid a pump upper body which are separated from each other and formed of a hard material, where an pump inner body is coupled to insides of the pump main body and the pump upper body, so that, when contents are dispensed by changing a volume of the content temporary reservoir while the pump upper body moves up or down, with respect to the pump main body, the volume of the content temporary reservoir is changed by deforming the pump inner body. Thus, the components are prevented from being worn due to the friction between the pump main body and the pump upper body so that the product defective is prevented, thereby improving the reliability.

In addition, according to the present invention, there is provided a pump for discharging contents, which has a simple structure to be easily manufactured so that the productivity is improved and the product price is reduced.

Specifically, according to the present invention, the contents dispensing pump including the pump inner body and the dispensing valve separated from each, other are formed of mutually different materials to prevent the pump inner body from being billowed before the dispensing valve is operated, so that a constant amount of contents can be dispensed ail the time.

In addition, According to the present invention, the components constituting the contents dispensing pump are formed of an elastic material such as rubber or synthetic resin durable to a chemical material, so that the opening and closing means may be prevented from being corroded due to the contents, and a metallic material is not used for valve means in the contents dispensing pump so that the used content discharging pump may be recycled.

In addition, the contents dispensing pump has a short working stroke distance so that the contents dispensing pump may be easily applied to a product such as a compact having a height less than a width thereof.

BEST MODE

Mode for Invention

It should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation.

Figure 1:
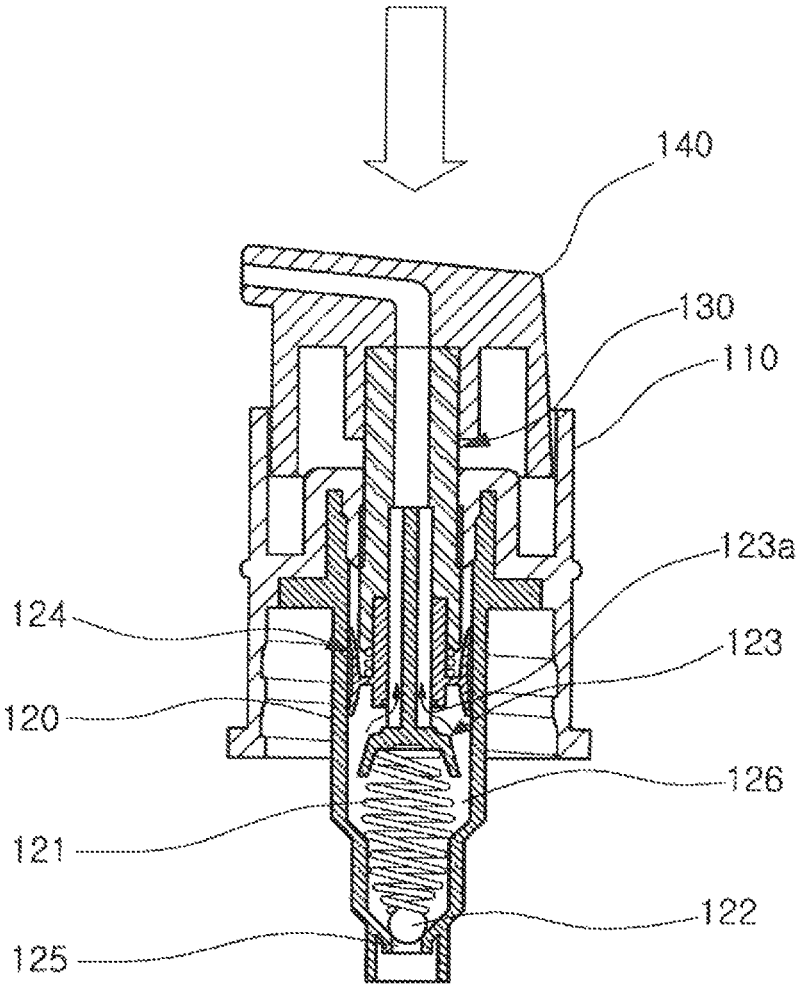
FIG. 1 is a view illustrating an exemplary state that a contents dispensing pump is operated to dispense contents according to the related art.
Figure 2:
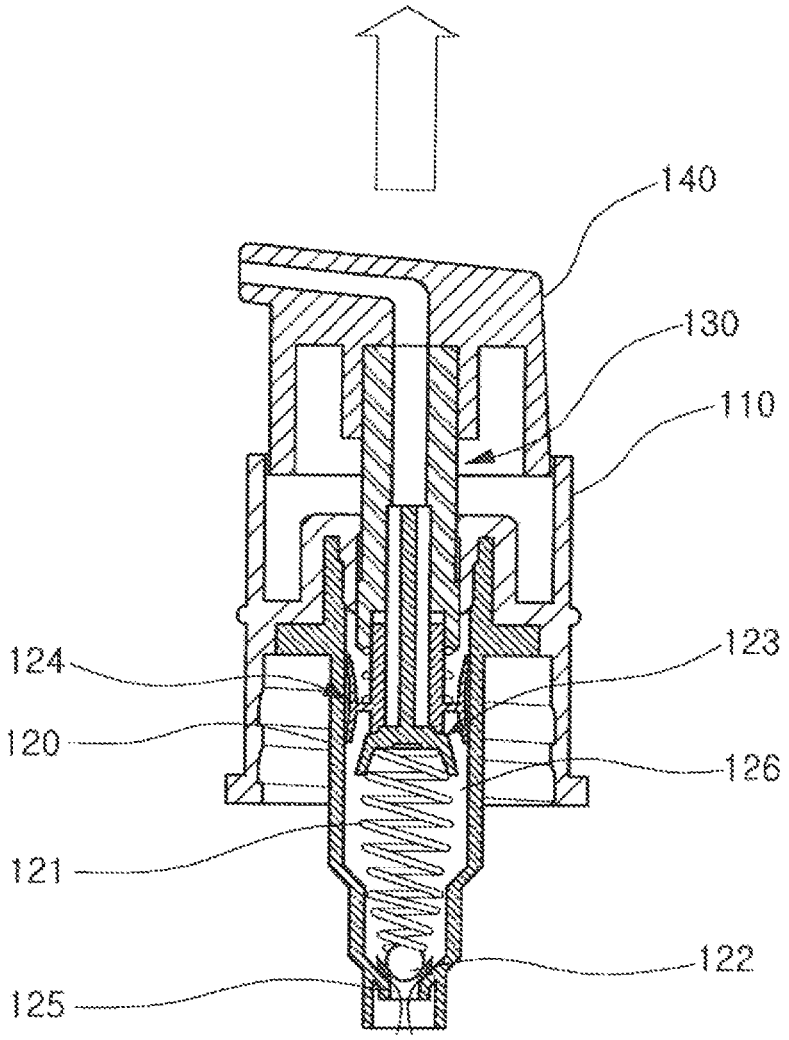
FIG. 2 is a view illustrating an exemplary state that a contents dispensing pump is restored to an original state when force is removed from the contents dispensing pump according to the related art.
Figure 3:
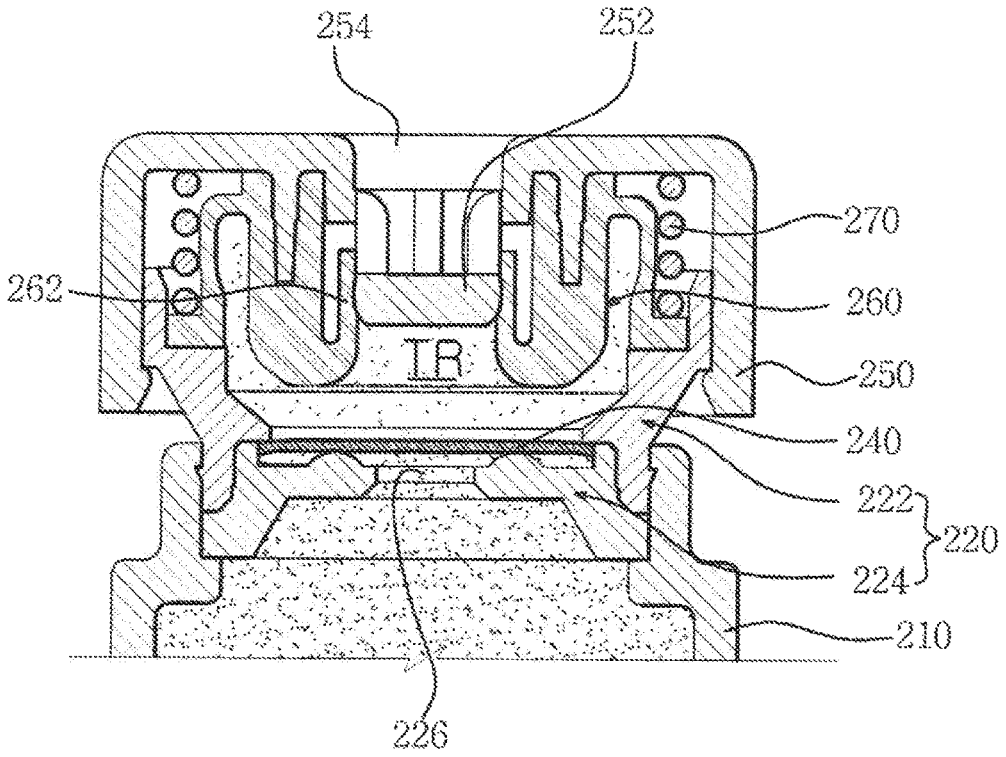
FIG. 3 is an assembled sectional view of a contents dispensing pump according to another example of the related art.
Figure 4:
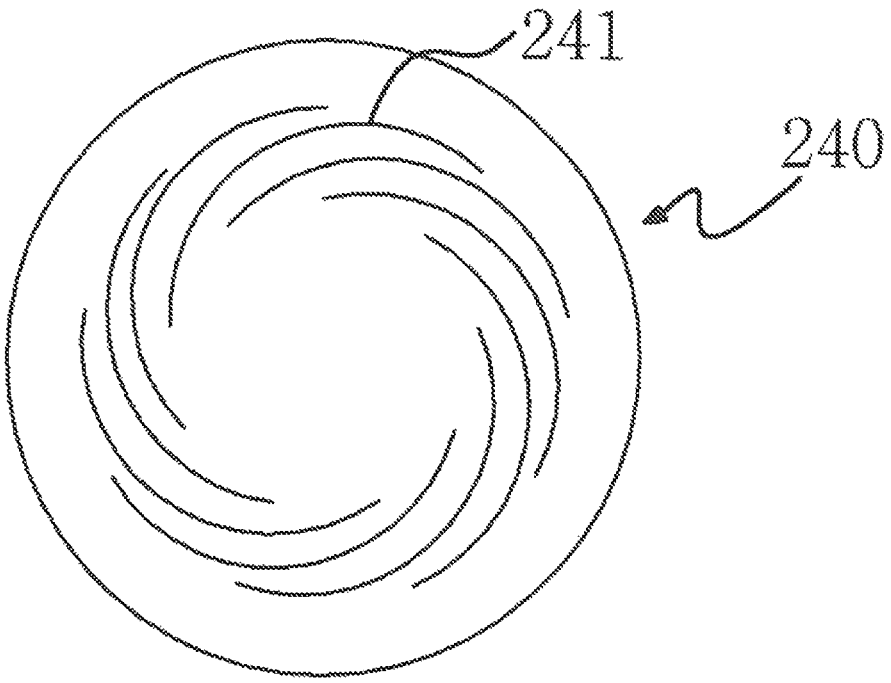
FIG. 4 is a plan view showing a valve plate of a contents dispensing pump according to still another example of the related art.
Figure 5:
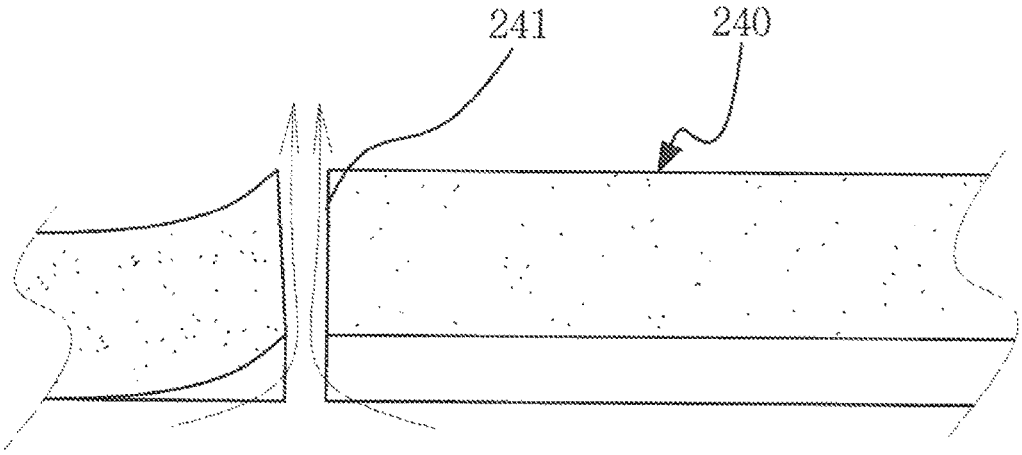
FIG. 5 is a sectional view showing an operating state of opening/closing lines of a valve plate applied to a contents dispensing pump according to still another example of the related art.
Figure 6:
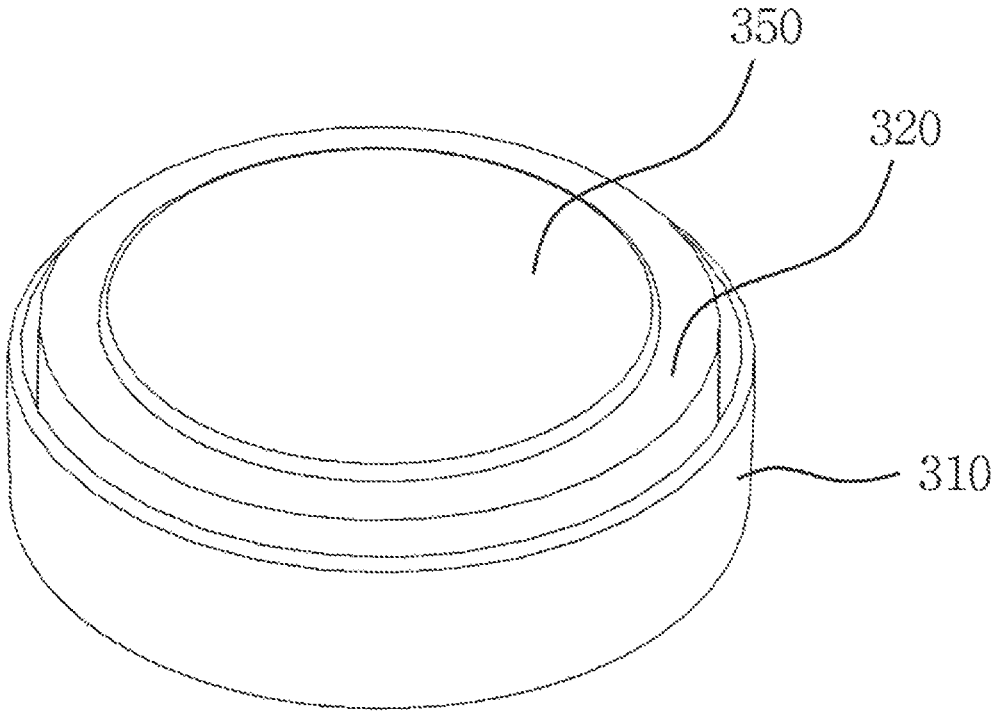
FIG. 6 is an assembled perspective view of a contents dispensing pump according to still another example of the related art.
Figure 7:
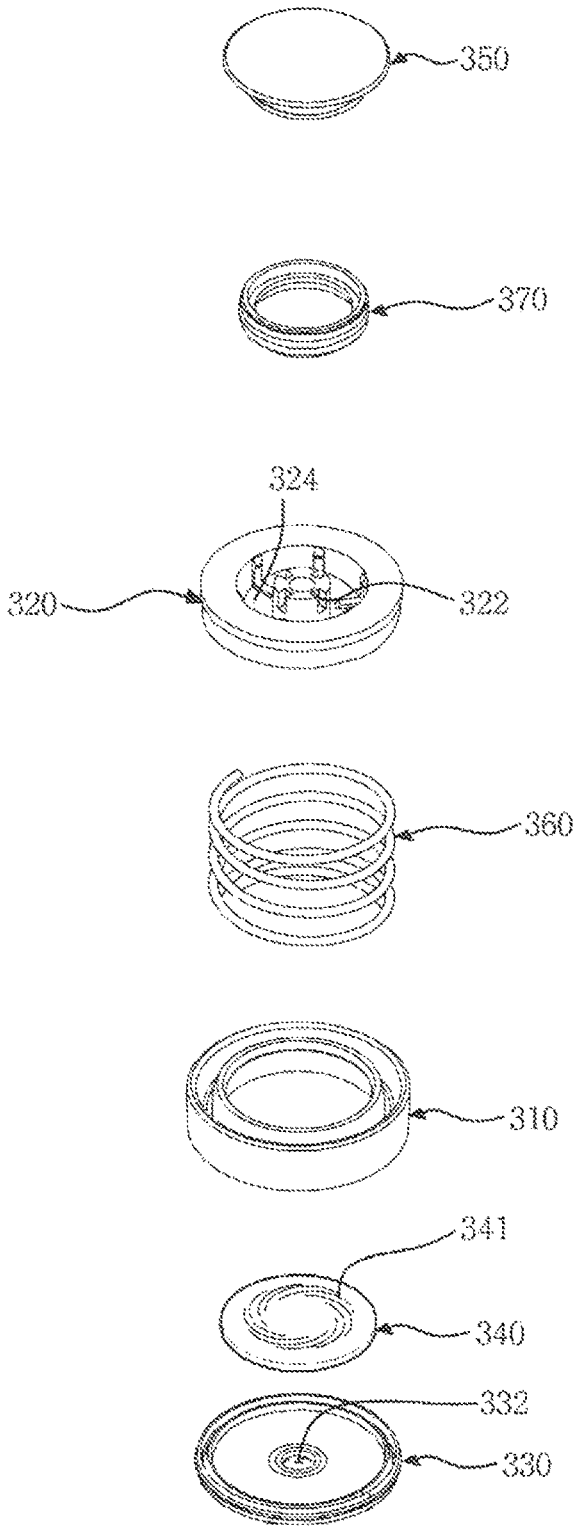
FIG. 7 is an exploded perspective view of a contents dispensing pump according to still another example of the related art.
Figure 8:
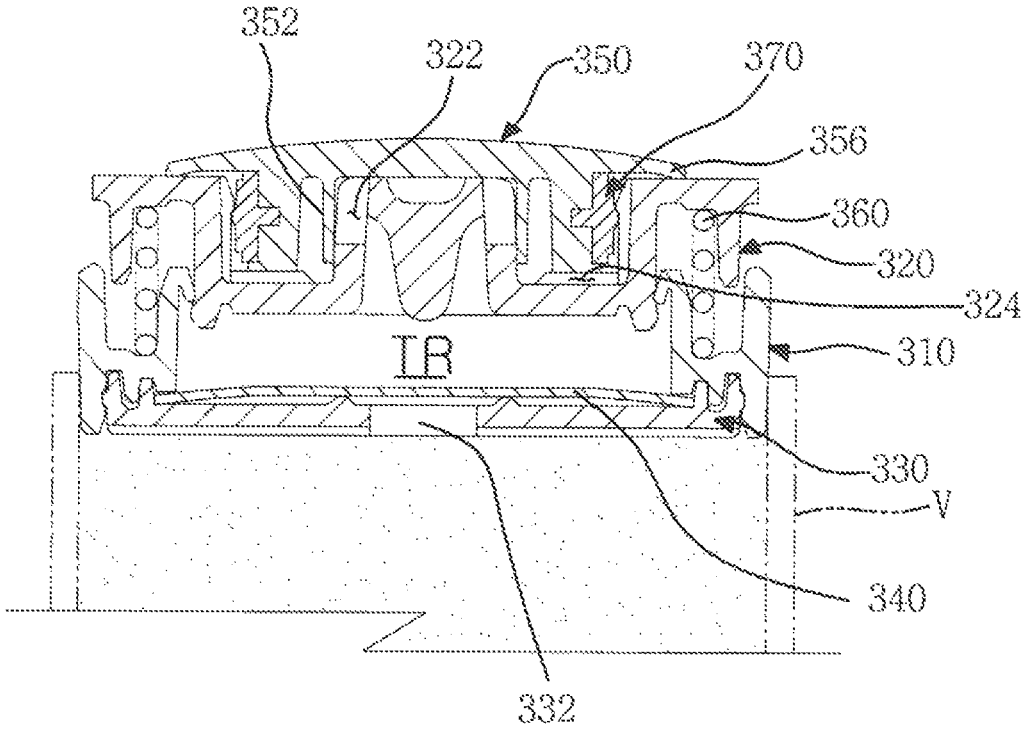
FIG. 8 is an assembled sectional view of a contents dispensing pump according to still another example of the related art.
Figure 9:
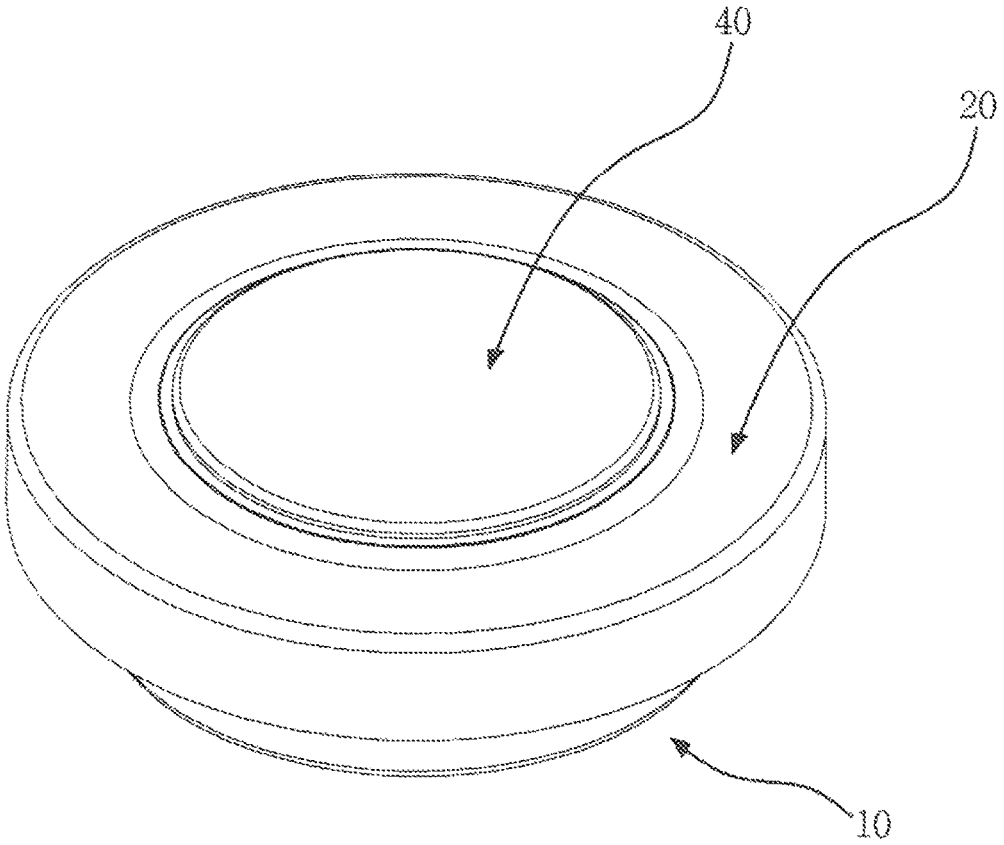
FIG. 9 is an assembled perspective view of a contents dispensing pump according to still another example of the related art.
Figure 10:
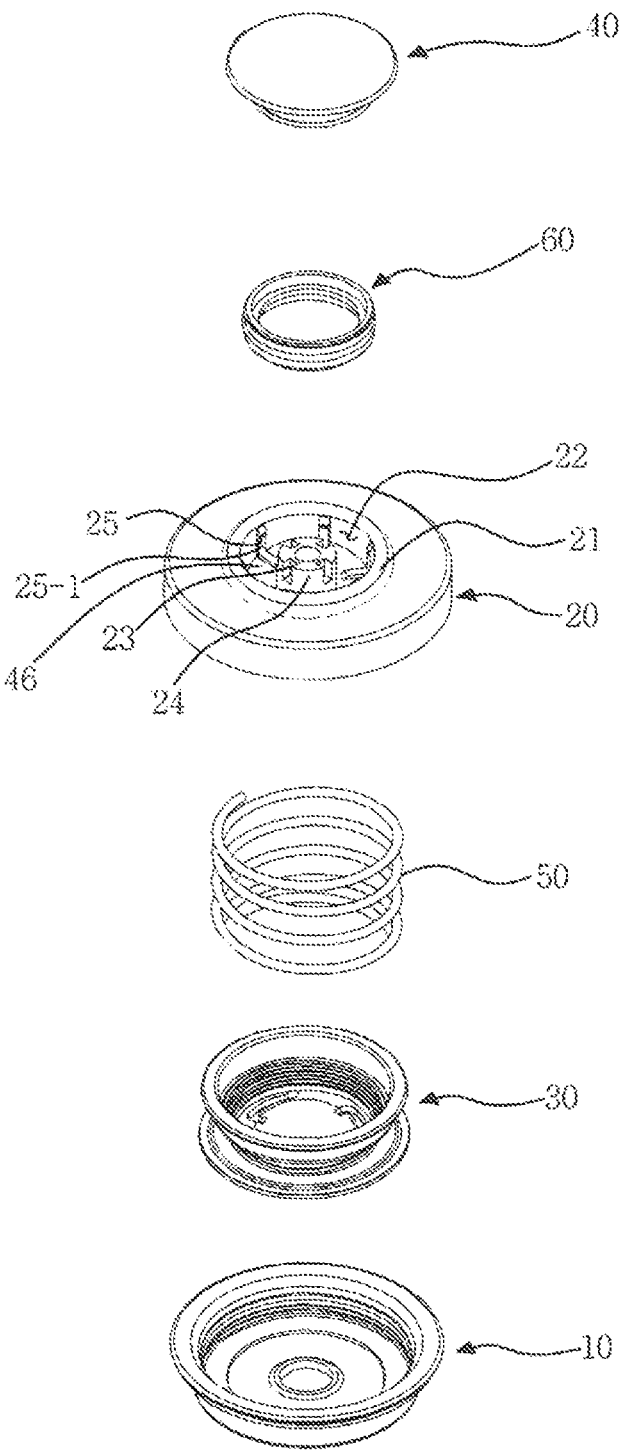
FIG. 10 is an exploded perspective view of a contents dispensing pump according to an embodiment of the present invention.
Figure 11:
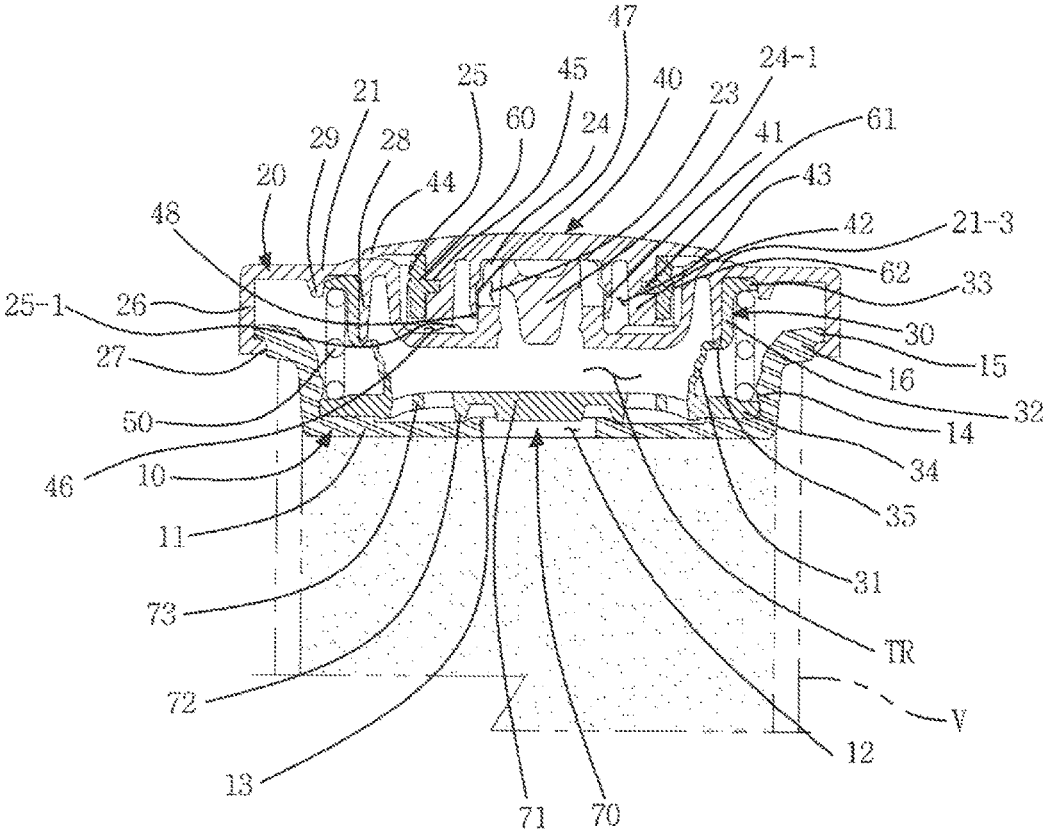
FIG. 11 is an assembled sectional view of a contents dispensing pump according to an embodiment of the present invention.
Figure 12:
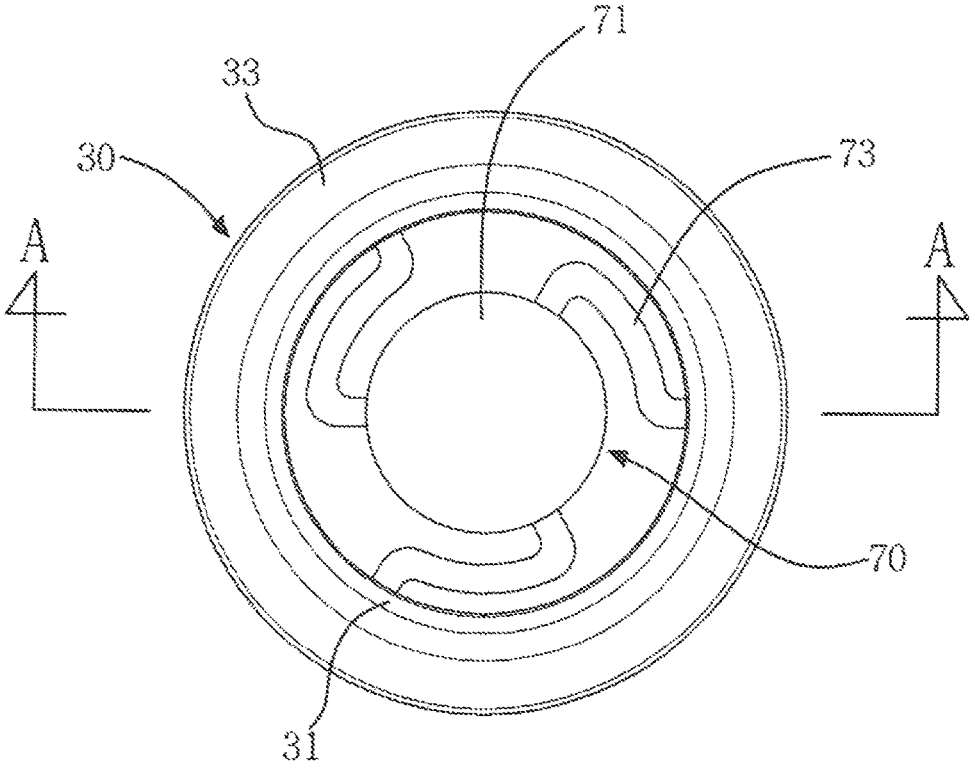
FIG. 12 is a plan view of a pump inner body applied to the present invention.
Figure 13:
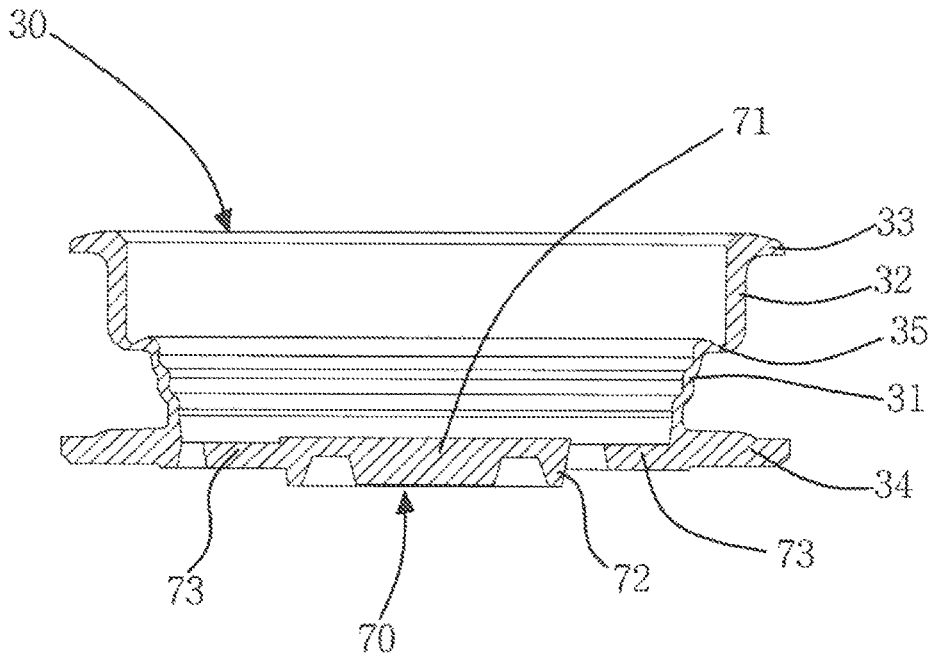
FIG. 13 is a sectional view taken along line A-A'.
Figure 19:
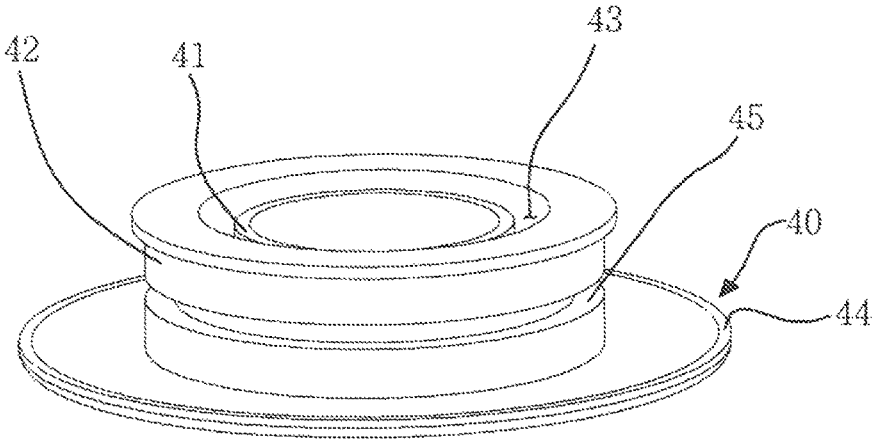
FIG. 19 is a bottom view of a dispensing valve applied to the present invention.
Figure 20:
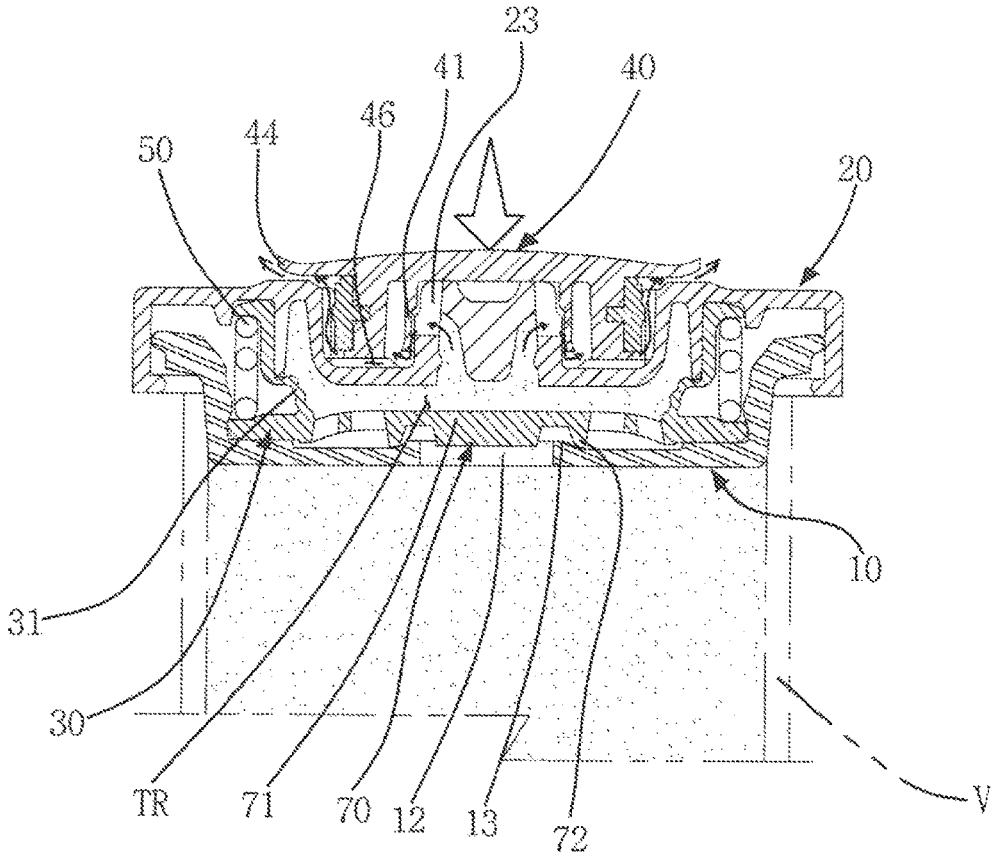
FIG. 20 is a sectional view showing a state that a contents dispensing pump is operated to discharge contents according to an embodiment of the present invention.
Figure 21:
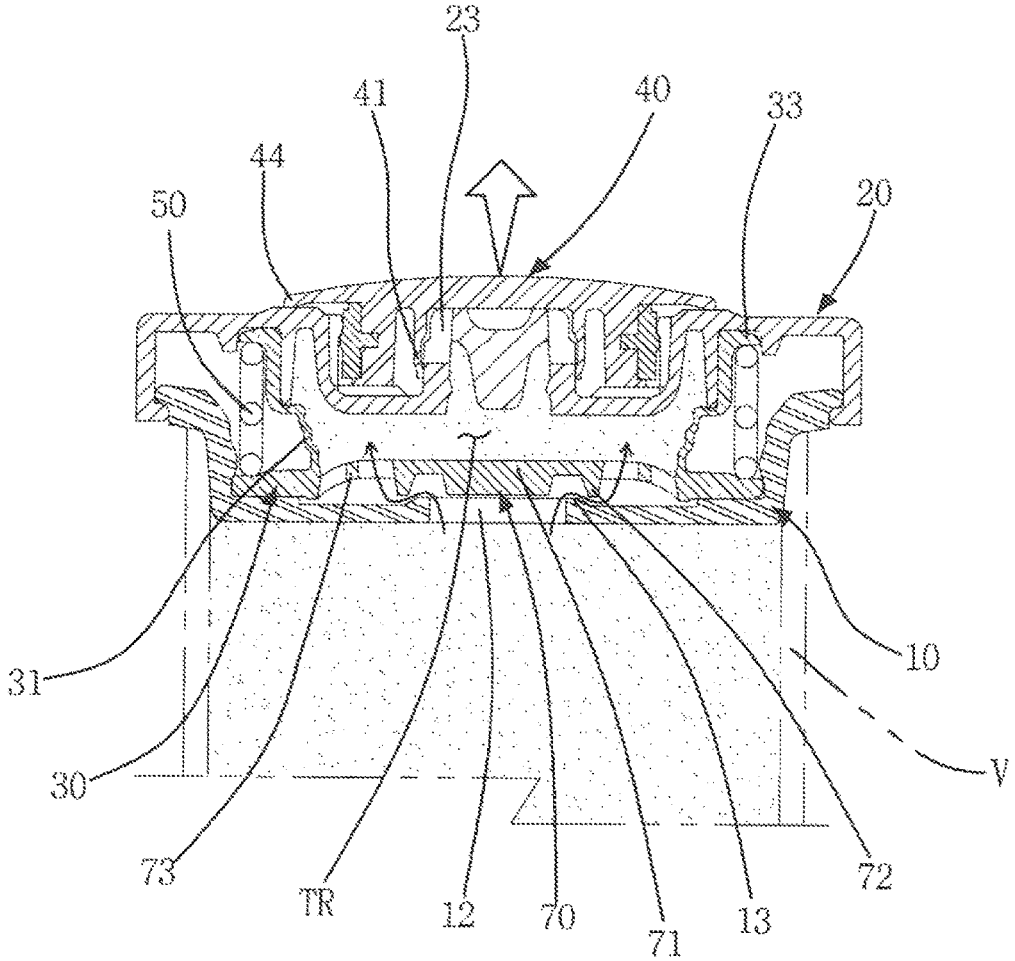
FIG. 21 is a sectional view showing a state that a contents dispensing pump is restored to an original state by removing force from the contents dispensing pump according to an embodiment of the present invention.

FIG. 9 is an assembled perspective view of a contents dispensing pump according to still another example of the related art. FIG. 10 is an exploded perspective view of a contents dispensing pump according to an embodiment of the present invention. FIG. 11 is an assembled sectional view of a contents dispensing pump according to an embodiment of the present invention. FIG. 12 is a plan view of a pump inner body applied to the present invention. FIG. 13 is a sectional view taken along line A-A'. FIGS. 14 to 17 are plan views showing other examples of the pump inner body applied to the present invention. FIG. 13 is a sectional view showing an operating state of opening/closing lines of the pump inner bodies of FIGS. 14 to 17. FIG. 19 is a bottom view of a dispensing valve applied to the present invention.

Hereinafter an embodiment of the present invention will be described with reference to accompanying drawings.

As shown in FIGS. 6 to 9, a pump for discharging contents according to an embodiment of the present invention is coupled to a container V for containing the contents and includes a pump main body 10, a pump upper body 20, a pump inner body 30, a dispensing valve 40 and an elastic member 50.

The pump main body 10 has a bowl shape with the middle thereof formed to be dented so that a contents inlet 12 is formed in the center of a main body lower plate 11 and an inlet ring-type protrusion part 13 is formed on the outer side of the content inlet 12. The inlet ring-type protrusion part 13 is provided to enhance the air-tightness of a suction valve plate 70.

A pump inner body latching sill 14 is formed in the inner side surface so as to be coupled to the pump inner body 30. The pump inner body latching sill 14 is formed in a protrusion wheel or protrusion shape and undercut coupled to a lower side surface extension piece 34.

In addition, a main body extension piece 16 is further formed on an outer upper end of the pump main body 10. A pump upper body latching protrusion wheel 15 may be provided on an end of the main body extension piece is to prevent the pump upper body 20 from being separated.

The pump upper body 20 is coupled to an upper portion of the pump main body 10 such that the pump upper body 20 moves up or down with respect to the pump main body 10, thereby performing a pumping operation. The pump upper body 20 is provided on a central part of an upper body upper plate 21 with a concaved dispensing valve coupling space 22. A dispensing protrusion rod 24 having a content outlet 23 is formed in the center of the dispensing valve coupling space 22.

The upper body upper plate 21 may be flat. Although a sealing piece 44 protrudes to form a protrusion 21-3, there is no difference in the pumping work. When the protrusion 21-3 is formed, the dispensed contents may easily flow out to an outside while passing through the protrusion 21-3.

A content induction rod (24-1) having a streamlined surface may be formed on an inner lower portion of the dispensing protrusion rod (24) such that the contents in the content temporary reservoir TR may smoothly transfer when the contents are dispensed.

A dispensing valve coupling sill 25, to which the dispensing valve 40 is coupled, is provided on a side wall surface of the dispensing valve coupling space 22. In addition, protrusion pieces 25-1 are formed on a side surface and a bottom surface of the dispensing valve coupling space 22 such that a path 46 which allows contents to flow through a space between the protrusion pieces 25-1 is formed.

In addition, a first coupling extension piece 28 which is formed below an upper body upper plate 21 and is coupled to the pump inner body 30, and a second coupling extension piece 29 which is spaced apart from the first coupling extension piece 28 by a predetermined interval and formed at an outer side than the first coupling extension piece 28 are formed such that a pump upper body coupling piece 32 and an upper side surface extension piece 33 of the pump inner body 30 are interposed between the first and second coupling extension pieces 28 and 29.

Figure 24:
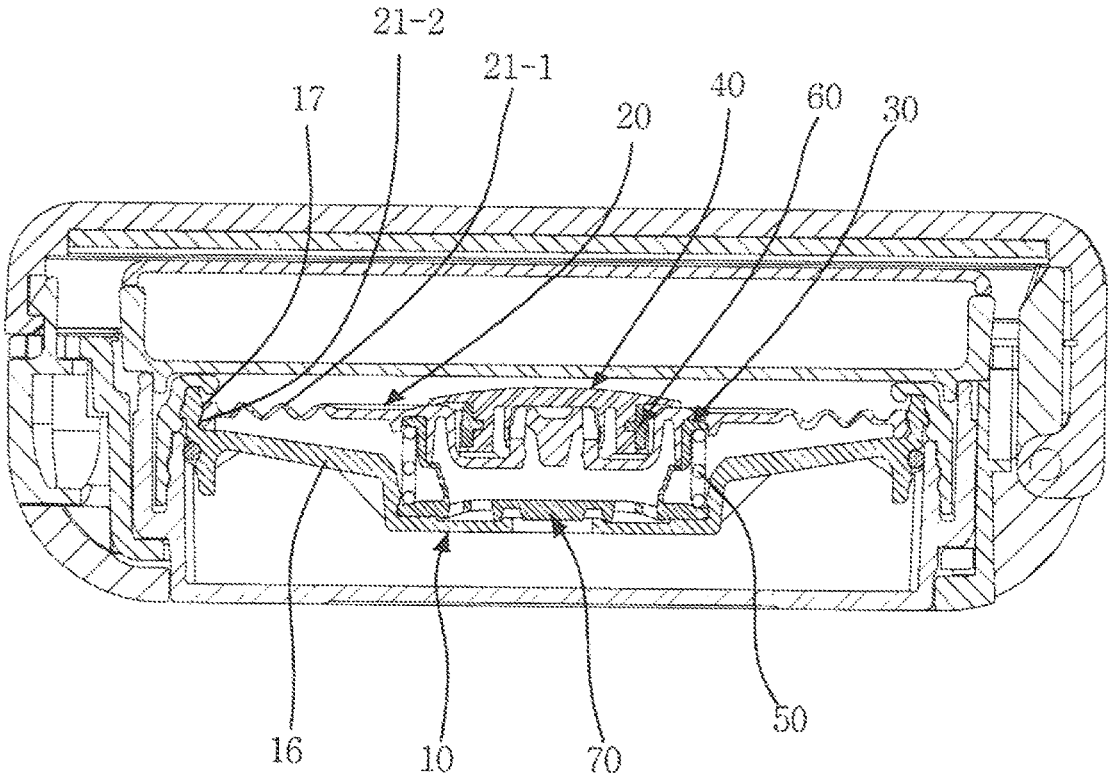
FIG. 24 is a sectional view entirely showing a state that a contents dispensing pump is applied to a compact container according to an embodiment of the present invention.

In addition, an upper extension piece 26 is formed below an outer end of the pump upper body 20 and a pump main body latching protrusion wheel 27 is formed on an inner end of the upper body extension piece 26 to latch the pump tipper body 20 to the pump upper latching protrusion 15 of the pump main body 10. As shown in FIG. 24, the upper body upper plate 21 may extend to form a tension bar 21-1. A main body fixing protrusion 21-2 may be formed on an end of the tension bar 21-1 to undercut couple the main body fixing protrusion 21-2 to the pump upper body fixing protrusion 17 of the pump main body 10, such that the pump upper body 20 is fixed to the pump main body 10.

The pump inner body 30 has a bowl shape with the middle thereof formed to be dented. A suction valve plate 70 is integrally formed on a bottom surface of the pump inner body 30 and a corrugate tube 31 is formed below a side surface of the pump inner body 30. A pump upper body coupling piece 32 coupled to the pump upper body 20 is formed on an upper portion of the pump inner body 30.

An upper side surface extension piece 33 extends from at an outside of an upper end of the pump upper body coupling piece 32 so that the upper side surface extension piece 33 is integrally formed at the outside of the upper end of the pump upper body coupling piece 32. A lower side surface extension piece 34 extends from an outside of a lower end of the corrugate tube 31 so that the lower side surface extension piece 34 is integrally formed at the outside of the lower end of the corrugate tube 31. A lower end of the pump upper body coupling piece 32 and an upper end of the corrugate tube 31 are integrally connected to the horizontal connection piece 35 such that a lower end of the first coupling extension piece 28 of the pump upper body 20 is pressed.

The upper side surface extension piece 33 of the pump inner body 30 is interposed between the first and second coupling extension pieces 28 and 29 of the pump upper body 20. The lower side surface extension piece 34 is interposed between the main body lower plate 11 of the pump main body 10 and the pump inner body latching sill 14.

An elastic member 50 is installed between the upper and lower side surface extension pieces 33 and 34 of the pump inner body 30 such that the upper and lower side surface extension pieces 33 and 34 are spaced apart from each other to tensely stretch the pump inner body 30.

In addition, the corrugate tube 31 is inwardly convex to be folded inwardly. The horizontal connection piece 35 on an upper end of the corrugate tube 31 is formed to be pressed by the first coupling extension piece (28) of the pump upper body (20). Thus, when the pump upper body 20 is pressed, the pump upper body coupling piece 32 interposed between the first and second coupling extension pieces 28 and 29 is pressed while the elastic member 50 is pressed. In addition, while the horizontal connection piece 35 is pressed by the end of the first coupling extension piece 28, the corrugate tube 31 is folded inwardly of the content temporary reservoir TR so that the volume of the content temporary reservoir TR is reduced to dispense the contents.

Since the pump inner body 31 having the corrugate tube 31 is repeatedly folded and unfolded, the pump inner body 31 is required to be formed of a material having excellent elasticity. Thus, the pump inner body 31 is preferably formed of at least one of general rubber, elastomer, silicon rubber, NBR rubber, and synthetic resin having excellent elasticity and including polyethylene (PE) and polypropylene (PP).

The suction valve plate 70 constituting the bottom surface of the pump inner body 30 is provided at the center thereof with a valve plate 71 which covers the content inlet 12 of the pump main body 10. When a pressure is generated in the content temporary reservoir TR, the valve plate 71 is pressed downward due to the pushing pressure, thereby closing the content inlet 12. When a vacuum pressure is generated, the valve plate 71 lifts up due to the suction pressure, so that the contents inlet 12 is opened. The valve plate 71 makes surface contact with the periphery surface of the content inlet 12 so that valve plate 71 may open or close the content inlet 12.

As well as the valve plate 71, a valve plate ring-type protrusion 72 may be formed to make contact with the inlet ring-type protrusion part 13 of the pump main body 10 while crossing the inlet ring-type protrusion part 13. Since the valve plate ring-type protrusion 72 opens or closes the content inlet 12 while making line contact with the inlet ring-type protrusion part 13, the opening/closing ability may be more improved.

In addition, as shown in FIG. 12, an outer side surface of the valve plate 71 and an inner lower end of the pump inner body 30 are integrally formed through an elastic piece 73. The valve plate 71 and the valve plate ring-type protrusion 72 are downward pressed by the elastic piece 73, so that the valve plate 71 and the valve plate ring-type protrusion 72 are in contact with the pump main body 10 all the time, thereby closing the content inlet 12.

In addition, according to another example of the pump inner body applied to the present invention, as shown in FIGS. 14 to 17, a suction valve plate 70 having a different shape from that of the previous example thereof may be used.

Although the suction valve plate 70 according to the present invention is provided on a periphery thereof with the elastic piece 73, as shown in FIGS. 14 to 17, several opening/closing lines 74 are formed at a periphery of the valve plate 71, so that an elastic plate 75 may be formed between the opening/closing lines 74.

Figure 14:
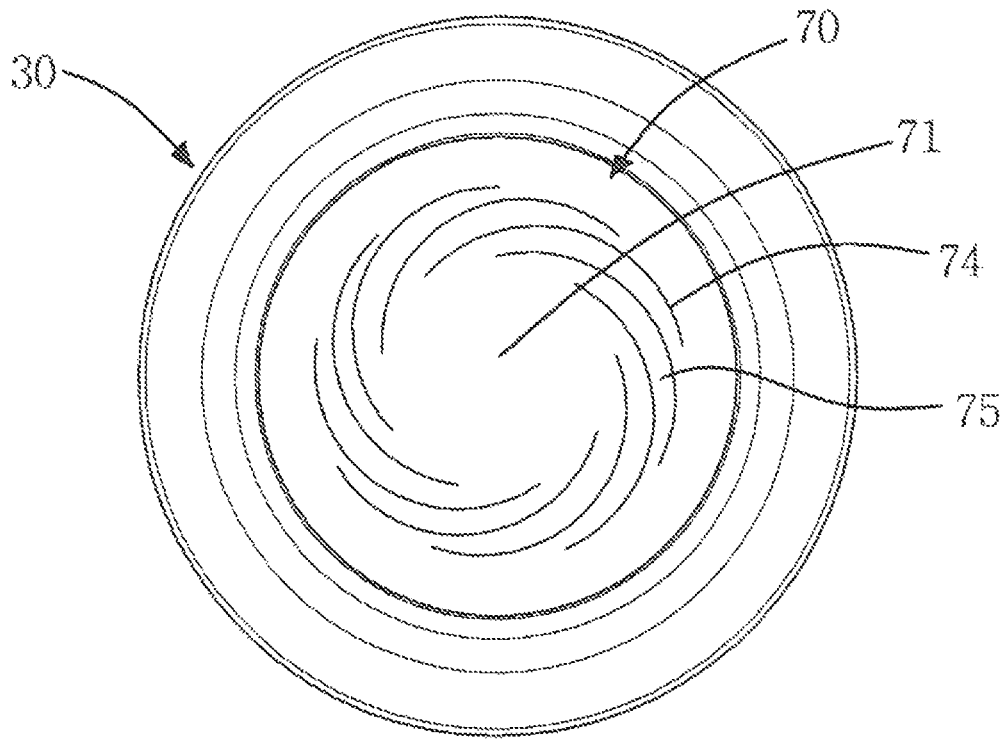
FIGS. 14 to 17 are plan views showing other examples of the pump inner body applied to the present invention.
Figure 15:
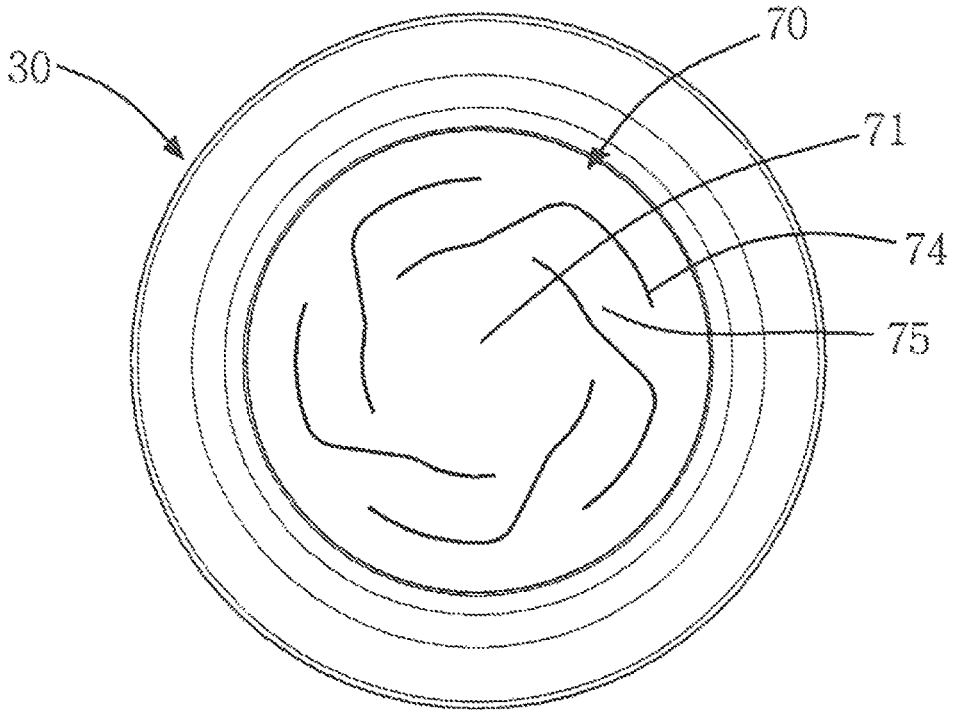
Figure 16:
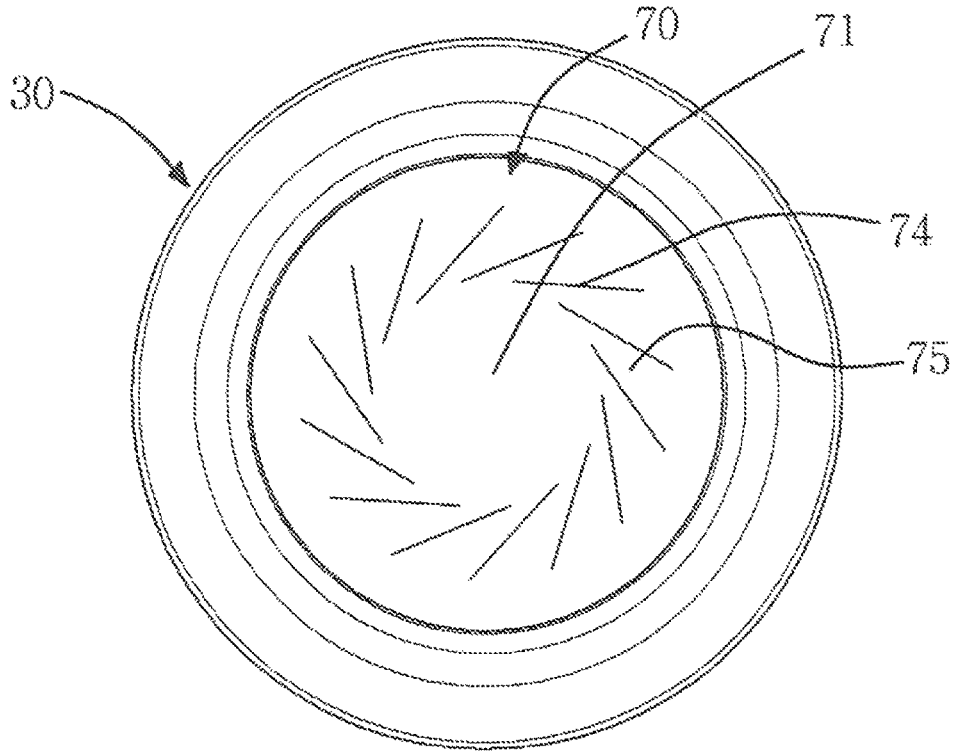
Figure 17:
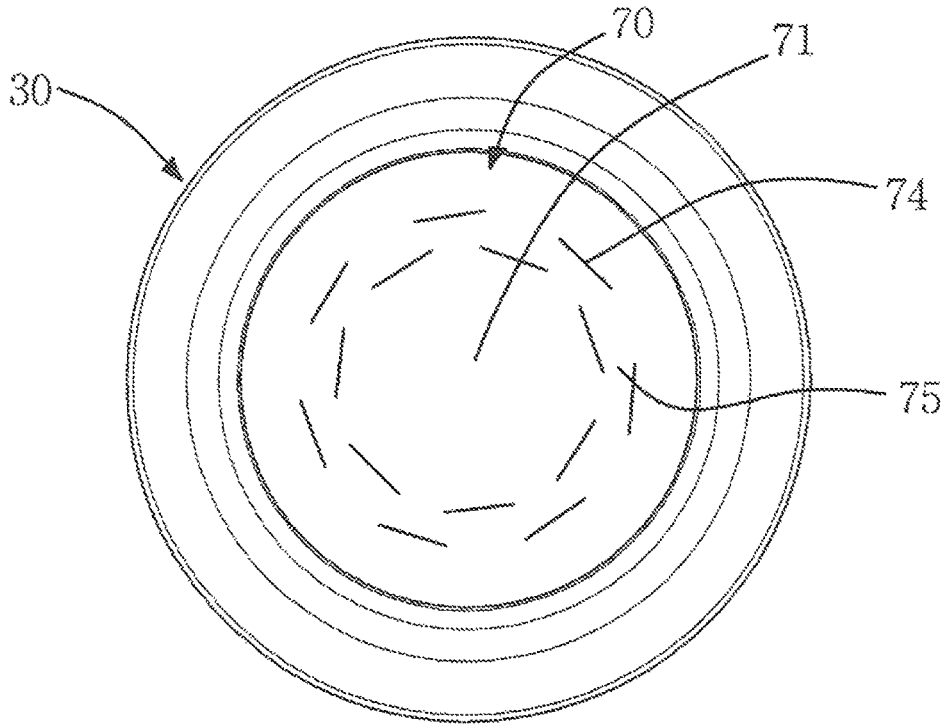

The opening/closing line 74 may include an arc shaped cutting line shown in FIG. 14, a broken line shaped cutting line as shown in FIG. 15, a diagonal shape cutting line shown in FIG. 16 or a straight line shaped cutting line shown in FIG. 17, but the shape of the opening/closing line 74 is not limited to a specific shape of the cutting line. If the elastic plate 75 is opened or closed by the elasticity of the elastic plate 75, any shapes may be applied to the elastic plate 75.

Figure 18:
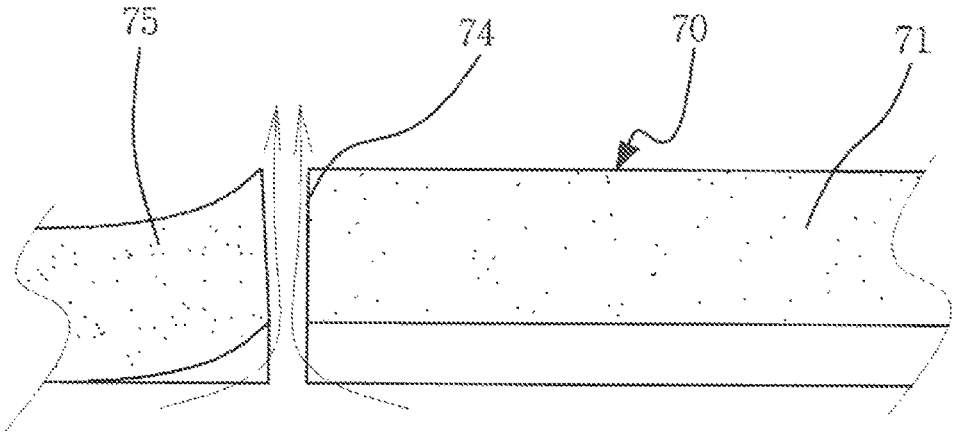
FIG. 18 is a sectional view showing an operating state of opening/closing lines of the pump inner bodies of FIGS. 14 to 17.

When the dispensing pressure is generated in the temporary reservoir TR by pushing the pump tipper body 20, since the opening/closing line 74 is tightly closed to the inlet ring-type protrusion part 13 of the pump main body 10, the boundary line of the opening/closing line 74 is closed. However, when the pressure on the pump upper body 20 is removed so that a vacuum pressure is generated in the temporary reservoir TR while the elastic member 50 moves up, as shown in FIG. 18, the valve plate 71 of the suction valve plate 40 is raised upward to allow the gap of the opening/closing line to be widened, so that the contents are transferred from the container V to the temporary repository TR through the gap of the opening/closing line 74.

The dispensing valve 40 is coupled to an upper side of the pump upper body 20 and is provided with a valve protrusion wheel 41 for opening or closing the content outlet 23 of the pump upper body 20. The dispensing valve (40) is provided at an outside of the valve protrusion wheel 41 with a coupling protrusion wheel 42 coupled to the pump upper body 20. A space unit 43 which is formed between the valve protrusion wheel 41 and the coupling protrusion wheel 42 and enables the valve protrusion wheel 41 to move when the valve protrusion wheel 41 is turned on or off.

The valve protrusion wheel 41 is provided on an inner side surface of the valve protrusion wheel 41 with a groove 47 and on an inner periphery of a lower end the valve protrusion wheel 41 with a sealing protrusion wheel 48. The sealing protrusion wheel 48 is tightly closed to the dispensing protrusion rod 24 of the pump upper body 20 to seal the content outlet 23. In addition, the sealing protrusion wheel 48 is tightly closed to a lower portion of the content outlet 23 of the dispensing protrusion rod 24 to enhance the air-tightness of the content outlet 23.

The dispensing valve 40 is integrally formed on an outer end thereof with a sealing piece 44 which makes contact with an upper body upper plate 21 of the pump upper body 20 or a protrusion 21-3 and is lifted up while being pushed by dispensing pressure when contents are discharged.

The dispensing valve 40 may be directly coupled with a dispensing valve coupling sill 25 of the pump upper body 20 by a coupling protrusion wheel 42, or a coupling auxiliary member may be fitted to an outer surface of the coupling protrusion wheel 42 such that the dispensing valve 40 can be coupled with the dispensing valve coupling sill 25 through the coupling auxiliary member 60.

In the case that the coupling auxiliary member 60 is fitted to the coupling protrusion wheel 42 of the dispensing valve 40, a fitting groove 45 is formed at an outer surface of the coupling protrusion wheel 42 and a fitting protrusion wheel 61 is formed at an inner surface of the coupling auxiliary member 60 in such a manner that the fitting protrusion wheel 61 can be fitted into the fitting groove 45.

When the dispensing valve 40 is coupled to the pump upper body 20, the coupling auxiliary member 60 is used as a coupling auxiliary unit. The coupling auxiliary member 60 is formed in a cylindrical shape. A fitting protrusion 61 coupled to the fitting groove 45 of the dispensing valve 40 is formed on an inner side surface of the coupling auxiliary member 60. A pump upper body coupling sill 62 coupled to the dispensing valve coupling sill 25 of the pump upper body 20 is formed on an outer side surface of the coupling auxiliary member 60.

After the fitting protrusion wheel 61 of the coupling auxiliary member 60 is fitted into the fitting groove 45 of the dispensing valve 40 such that the coupling auxiliary member 60 is coupled to the dispensing valve 40, the pump upper body coupling sill 62 of the coupling auxiliary member 60 is pressed to be undercut coupled to the dispensing valve coupling sill 25 such that the dispensing valve 40 and the pump upper body 20 are coupled to each other.

Although it is described in the embodiment that the coupling auxiliary member 60 is undercut coupled to the pump upper body 20, the embodiment is not limited thereto and it is possible that the coupling auxiliary member 60 is forcibly and fittingly coupled to the pump upper body 20.

When the dispensing valve 40 is coupled to the pump upper body 20, a path 46 through which contents are dispensed may be formed between the protrusion pieces 25-1 in the dispensing valve coupling space 22 of the dispensing valve 40 and the pump upper body 20.

The dispensing valve 40 is required to be formed of a material having excellent elasticity. Thus, the dispensing valve 40 is preferably formed of at least one of general rubber, elastomer, silicon rubber, NBR rubber, and synthetic resin having excellent elasticity and including polyethylene (PE) and polypropylene (PP).

The elastic member (50) is positioned between the upper lateral surface extension piece (33) and the lower lateral surface extension piece (34) of the pump inner body (30) so as to draw the pump inner body (30) and simultaneously elastically support the pump main body (10) and the pump upper body (20).

The elastic member 50 may be one of a synthetic resin, an elastomer, a rubber material and a metallic material. Since the elastic member 50 is positioned at an outer portion, of a pump inner body 30, the elastic member 50 does not directly make contact with the contents so that the contamination of contents caused by the chemical change can be prevented and durability can be improved.

Hereinafter, a method of assembling the contents dispensing pump having the above configuration according to the present invention will be described.

First, the pump inner body 30 is disposed inside the pump main body 10 and the lower side surface extension piece 34 of the pump inner body 30 is latched with the pump inner body latching sill 14 of the pump main body 10 through an undercut scheme, thereby fixing the pump inner body 30 to the pump main body 10.

Then, the elastic member 50 is fitted between the lower side surface extension piece 34 and the upper side surface extension piece 33 of the pump inner body 30, and the pump upper body coupling piece 32 and the upper side surface extension piece 33 of the pump inner body 30 are interposed between the first and second coupling extension pieces 28 and 29 of the pump upper body 20 such that the first coupling extension piece 28 of the pump upper body 20 presses the horizontal connection piece 35 of the pump inner body 30 while making contact with an upper surface of the horizontal connection piece 35.

After that, the pump upper body 20 is pressed such that the pump main body latching protrusion wheel 27 of the upper body extension piece 26 of the pump upper body 20 can be latched while crossing over the pump upper latching protrusion wheel 15 of the pump main body 10, thereby coupling the pump upper body 20 to the pump main body 10.

At this time, as shown in FIG. 24, in the case that the contents dispensing pump of the present invention is applied to the compact, the main body fixing protrusion 21-2 formed at the end of the tension bar 21-1 of the pump upper body 20 is coupled to the pump upper body fixing protrusion 17 of the main body extension piece 26 of the pump main body 10 through the undercut scheme, thereby fixing the pump upper body 20 to the pump main body 10.

Then, the valve protrusion wheel 41 of the dispensing valve 40 is capped on the dispensing protrusion rod 24 of the pump upper body 20, and simultaneously, the coupling protrusion wheel 42 of the dispensing valve 40 is press-fitted by directly pressing the coupling protrusion wheel 42 against the dispensing valve coupling space 22 of the pump upper body 20 or the coupling protrusion wheel 42 is coupled to the dispensing valve coupling sill 25 through the undercut scheme, thereby coupling the dispensing valve 40 to the pump upper body 20, otherwise, the dispensing valve 40 may be coupled to the pump upper body 20 by using the coupling auxiliary member 60.

When using the coupling auxiliary member 60, the fitting protrusion wheel 61 of the coupling auxiliary member 60 is fitted to the fitting groove 45 of the coupling protrusion wheel 42 of the dispensing valve 40 in order to couple the coupling auxiliary member 60 to the dispensing valve 40, and the coupling protrusion wheel 42 coupled with the coupling protrusion wheel 42 is press-fitted into the dispensing valve coupling space 22 of the pump upper body 20.

In this case, the valve protrusion wheel 41 of the dispensing valve 40 is capped on the dispensing protrusion rod 24 of the pump upper body 20, and simultaneously, the coupling auxiliary member 60 is press-fitted into the dispensing valve coupling space 22, otherwise, the pump upper body coupling sill 62 of the coupling auxiliary member 60 is coupled to the dispensing valve coupling sill 25 through the undercut scheme.

Figure 22:
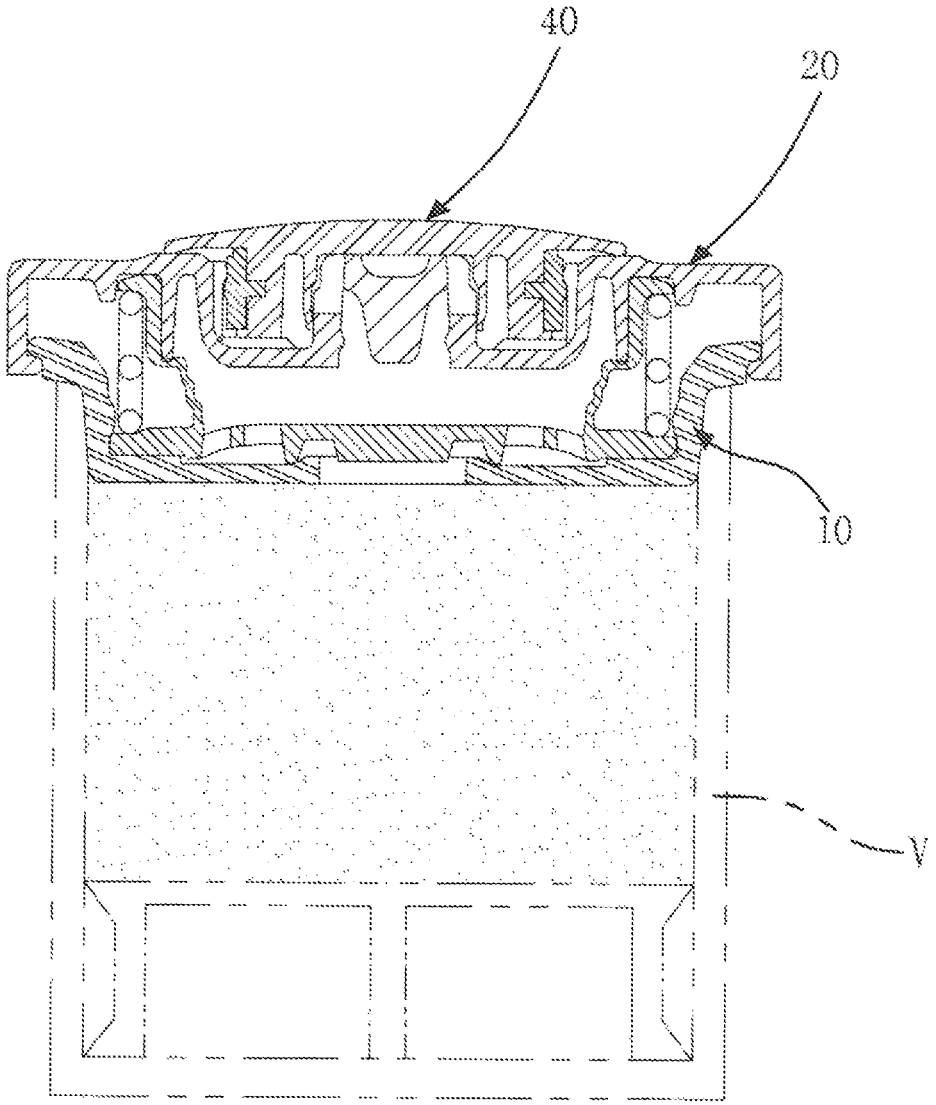
FIG. 22 is a sectional view entirely showing a state that a contents dispensing pump is applied to a cosmetic cream container according to an embodiment of the present invention.
Figure 23:
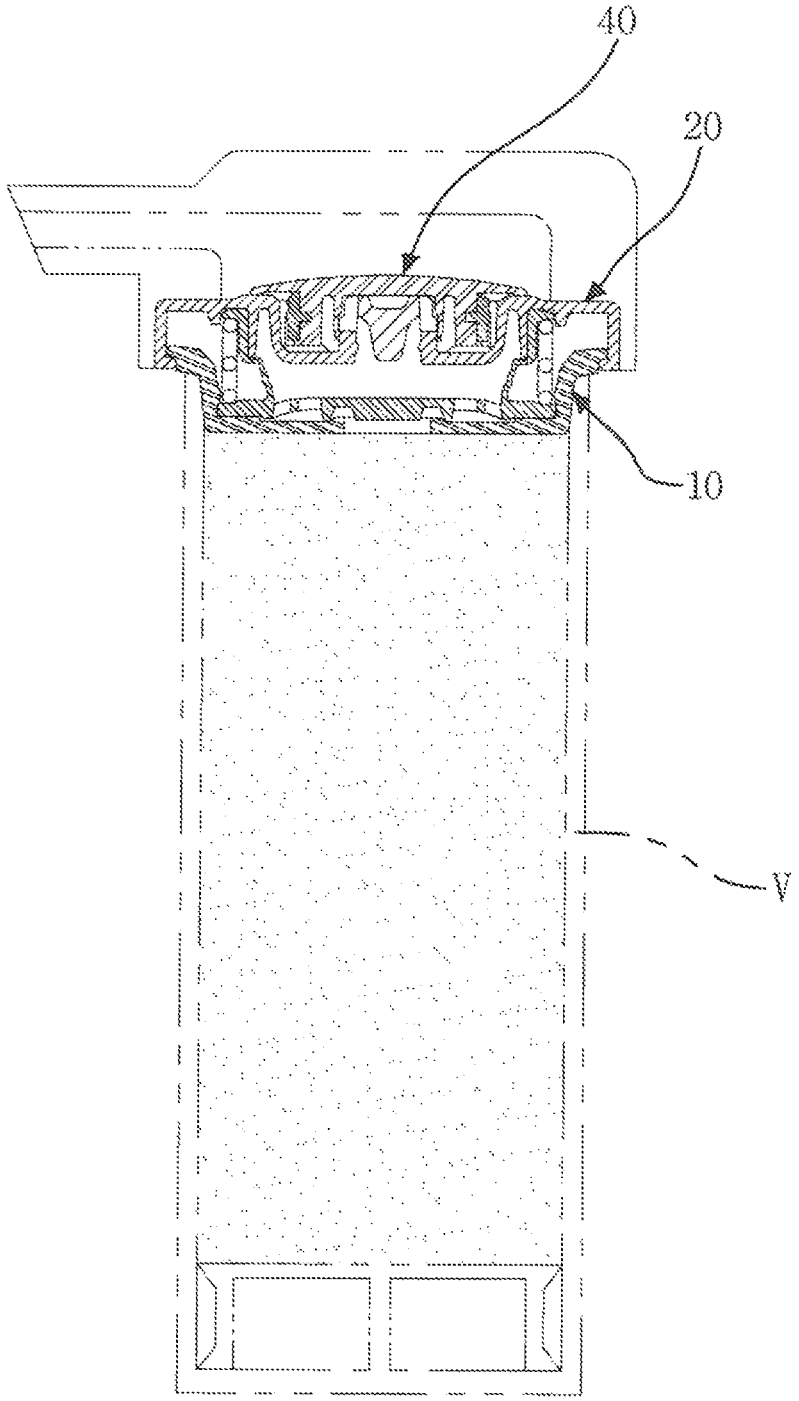
FIG. 23 is a sectional view entirely stowing a state that a contents dispensing pump is applied to a lotion container according to an embodiment of the present invention.

The contents dispensing valve assembled as described above according to the present invention can be fitted with the container V in use. For instance, the contents dispensing valve can be coupled with the cosmetic cream container, as shown in FIG. 22, can be coupled with the lotion container as shown in FIG. 23, or can be coupled with the compact container as shown in FIG. 24.

Hereinafter, the operation of the contents dispensing pump having the above configuration according to the present invention will be described.

The contents dispensing pump according to the present invention is coupled with the contents container V in use. For instance, the contents dispensing pump can be used for a normal cosmetic container, a daily supply container, a food container or a medicine container and can be applied to a packaging container such as a compact cosmetic container having a height smaller than a width thereof.

In the contents dispensing valve having the above configuration according to one embodiment of the present invention, when an tipper surface of the pump upper body 20 or the dispensing valve 40 is pushed to allow the pump upper body 20 to move down with respect to the pump main body 10, the elastic member 50 is compressed and the corrugate tube 31 is folded so that the volume of the content temporary repository TR is reduced. Thus, discharge pressure is generated in the content temporary repository TR so that the contents in the content temporary repository TR may be discharged to the content outlet 23. Accordingly, the valve protrusion wheel 41 adhering to the content outlet 23 is open caused by the discharge pressure so that the contents pass through a gap between the content outlet 23 and the valve protrusion wheel 41. Then, the contents pass through the path 46 formed between the pump upper body 20 and the dispensing valve 40. After that, the discharge pressure is applied to the sealing piece 44 formed at the upper peripheral portion of the dispensing valve 44 so that the sealing piece 44 is pulled inward and open, thereby allowing the contents to be discharged through a gap created by the sealing piece 44.

At this time, the inlet valve plate 70 is pushed down by the discharge pressure of the content temporary repository TR, so that the valve plate ring-type protrusion 72 presses the inlet ring-type protrusion 13 of the pump main body 10, thereby closing the content inlet 12.

In addition, as shown in FIG. 24, in the case that the contents dispensing pump according to the present invention is applied to the compact container, if the pump upper body 20 is moved down with respect to the pump main body 10 by pushing the top surface of the pump upper body 20 or the dispensing valve 40, the elastic member 50 is compressed so that the contents in the pump inner body 30 are discharged, and simultaneously, since the end of the tension bar 21-1 is fixed to the main body extension piece 16 of the pump main body 10, the tension bar 21-1 is bent while being subject to the elastic force, so that the pump upper body 20 moves down.

In addition, when the pressure on the upper surface of the dispensing valve 40 or the pump upper body 20 is removed, while the pump upper body 20 moves up by restoring force of an elastic member 50, the upper side surface extension piece extension 33 moves up together so that the corrugate tube 31 is unfolded. Thus, since the volume of the content temporary repository TR is increased, the vacuum pressure in the content temporary repository TR is generated so that the valve protrusion wheel 41 of the dispensing valve 40 closes the content outlet 23. When the valve plate 71 of the suction valve plate 70 is raised upward due to the vacuum pressure, while the valve plate ring-type protrusion 72 is spaced apart from the inlet ring-type protrusion part 13, the content inlet 12 is opened so that the contents in the container V are transferred to the content temporary repository TR.

As shown in FIG. 12, in case that the pump inner body 30 according to one embodiment of the present invention is used, when contents transfer from the container V to the content temporary reservoir TR, the valve plats 71 lifts up while the elastic piece 73 of the suction valve plate 70 is elastically deformed, when the contents flow into the content temporary reservoir TR so that the vacuum pressure is removed, the valve plate 71 is closed on the content inlet 12 again due to the elastic force of the elastic piece 73 of the suction valve plate 70.

In addition, as shown in FIGS. 14 to 27, in case that the pump inner body 30 according to another embodiment of the present invention is used, when contents transfer from the container V to the content temporary reservoir TR, as shown in FIG. 18, while the valve plate 71 of the suction valve plate 70 lifts up, the elastic piece 73 of the suction valve plate 70 is elastically deformed so that the opening/closing line 41 is widened, so the contents flow from the container V into the content temporary reservoir TR through the gap of the opening/closing line 41. As the contents flow from the container V into the content temporary reservoir TR, when the vacuum pressure is removed, the valve plate 71 is closed on the content inlet 12 again due to the elastic force of the elastic plate 75 of the suction valve plate 70.

As described above, the contents dispensing pump described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Pump main body
11: Pump lower plate
12: Content inlet
13: Inlet ring-type protrusion part
14: Pump inner body latching sill
15: Pump upper body latching protrusion wheel
20: Pump upper body
21: Upper body upper plate
22: Dispensing valve coupling space
23: Content outlet
24: Dispensing protrusion rod
24-1: Content induction rod
25: Dispensing valve coupling sill
26: Upper body extension piece
27: Pump main body latching protrusion wheel
28: First coupling extension piece
29: Second coupling extension piece
30: Pump inner body
31: Corrugate tube
32: Pump upper body coupling piece
33: Upper side surface extension piece
34: Lower side surface extension piece
35: Horizontal extension piece
40: Dispensing valve
41: Valve protrusion wheel
42: Coupling protrusion wheel
43: Space part
44: Sealing piece
45: Fitting groove
46: Path
50: Elastic member
60: Coupling auxiliary member
61: Fitting protrusion wheel
62: Pump upper body coupling sill
70: Suction valve plate
71: Valve plate
72: Valve plate ring-type protrusion
73: Elastic piece

The invention claimed is:

1. A contents dispensing pump coupled to a container (V) for containing contents therein to dispense the contents, the contents dispensing pump comprising:

a pump main body (10) including a main body lower plate (11) provided at a central portion thereof with a content inlet (12);

a pump upper body (20) coupled to an upper portion of the pump main body (10) to move vertically with respect to the pump main body (10) and provided with a dispensing protrusion rod (24) having a content outlet (23);

a pump inner body (30) positioned in the pump main body (10) and provided at a lower surface thereof with an absorbing valve plate (70);

a dispensing valve (40) provided with a valve protrusion wheel (41) for opening or closing the content outlet (23), having a coupling protrusion wheel (42) which surrounds the dispensing protrusion rod (24); and an elastic member (50) positioned at an outside of the pump inner body (30) to tensely stretch the pump inner body (30) and elastically support the pump main body (10) and the pump upper body (20), wherein the dispensing valve (40) is positioned on a top surface of the pump upper body (20), wherein the pump inner body (30) comprises:

a corrugate tube (31) formed below a side surface of the pump inner body (30) to be inwardly folded while the elastic member (50) is compressed, and having a lower side surface extension piece (34) integrally formed at an outside of a lower end thereof;

a pump upper body coupling piece (32) having a substantially cylindrical shape on an upper portion of the pump inner body (30); and an upper side surface extension piece (33) extending from an outer side of an upper end of the pump upper body coupling piece (32), wherein the elastic member (50) is installed from the upper side surface extension piece (33) to the lower side surface extension piece (34), wherein the pump inner body (30) is made of an elastic material, and wherein a horizontal distance of the pump inner body (30) is greater than a height of the pump inner body (30).

2. A contents dispensing pump coupled to a container (V) for containing contents therein to dispense the contents, the contents dispensing pump comprising:

a pump upper body (20) coupled to an upper portion of a pump main body (10) to move vertically with respect to the pump main body (10) and provided with a dispensing protrusion rod (24) having a content outlet (23); and a dispensing valve (40) provided with a valve protrusion wheel (41) for opening or closing the content outlet (23) having a coupling protrusion wheel (42) which surrounds the dispensing protrusion rod (24), wherein, when an upper surface of the pump upper body (20) or the dispensing valve (40) is pushed to allow the pump upper body (20) to move down with respect to a pump main body (10), a corrugate tube (31) of a pump inner body (30) is formed below a side surface of the pump inner body (30) to be inwardly folded while an elastic member (50) is compressed such that a volume of a content temporary reservoir (TR) is reduced to generate a discharge pressure in the content temporary reservoir (TR), wherein, when contents in the content temporary reservoir (TR) are pressed to be output through a content outlet (23), a valve protrusion wheel (41) coming into close contact with the content outlet (23) is widened by the discharge pressure such that the contents are dispensed through a gap between the content outlet (23) and the valve protrusion wheel (41), and wherein an absorbing valve plate (70) is downward pressed by the discharge pressure of the content temporary reservoir (TR) to close the content inlet (12) of the pump main body (10), wherein the dispensing valve (40) is positioned on a top surface of the pump upper body (20), wherein the pump inner body (30) comprises:

a pump upper body coupling piece (32) having a substantially cylindrical shape on an upper portion of the pump inner body (30); and an upper side surface extension piece (33) extending from an outer side of an upper end of the pump upper body coupling piece (32), wherein the corrugate tube (31) has a lower side surface extension piece (34) integrally formed at an outside of a lower end thereof;

wherein the elastic member (50) is installed from the upper side surface extension piece (33) to the lower side surface extension piece (34), wherein the pump inner body (30) is made of an elastic material, and wherein a horizontal distance of the pump inner body (30) is greater than a height of the pump inner body (30).

3. A contents dispensing pump coupled to a container (V) for containing contents therein to dispense the contents, the contents dispensing pump comprising:

a pump upper body (20) coupled to an upper portion of a pump main body (10) to move vertically with respect to the pump main body (10) and provided with a dispensing protrusion rod (24) having a content outlet (23); and a dispensing valve (40) provided with a valve protrusion wheel (41) for opening or closing the content outlet (23), having a coupling protrusion wheel (42) which surrounds the dispensing protrusion rod (24), wherein, when a pressure on an upper surface of the pump upper body (20) or the discharge valve (40) is removed, the pump upper body (20) lifts up by a restoring force of an elastic member (50) so that an upper side surface extension piece (33) of a pump inner body (30) together moves up, thereby unfolding a folded corrugate tube (31), so a volume of a content temporary reservoir (TR) is increased so that a vacuum pressure is generated in the content temporary reservoir (TR) and a content outlet (23) is closed by a valve protrusion wheel (41) of the discharge valve (40), wherein a content inlet (12) of a pump main body (10) is opened while a valve plate (71) of an absorbing valve plate (70) lifts up due to the vacuum pressure, so that contents in the container (V) are transferred into the content temporary reservoir (TR), and wherein, when the vacuum pressure of the content temporary reservoir (TR) is removed as the contents are transferred into the content temporary reservoir (TR), the valve plate (71) is restored to an original state thereof due to elasticity of an elastic piece (73), wherein the dispensing valve (40) is positioned on a top surface of the pump upper body (20), wherein the pump inner body (30) comprises:

a pump upper body coupling piece (32) having a substantially cylindrical shape on an upper portion of the pump inner body (30); and an upper side surface extension piece (33) extending from an outer side of an upper end of the pump upper body coupling piece (32), wherein the corrugate tube (31) formed below a side surface of the pump inner body (30) to be inwardly folded while the elastic member (50) is compressed, and having a lower side surface extension piece (34) integrally formed at an outside of a lower end thereof, wherein the elastic member (50) is installed from the upper side surface extension piece (33) to the lower side surface extension piece (34), wherein the pump inner body (30) is made of an elastic material, and wherein a horizontal distance of the pump inner body (30) is greater than a height of the pump inner body (30).

4. A contents dispensing pump coupled to a container (V) for containing contents therein to dispense the contents, the contents dispensing pump comprising:

a pump upper body (20) coupled to an upper portion of a pump main body (10) to move vertically with respect to the pump main body (10) and provided with a dispensing protrusion rod (24) having a content outlet (23); and a dispensing valve (40) provided with a valve protrusion wheel (41) for opening or closing the content outlet (23), having a coupling protrusion wheel (42) which surrounds the dispensing protrusion rod (24), wherein a pump inner body (30) having an absorbing valve plate (70) is coupled to an inside of a pump main body (10), wherein the pump inner body (30) comprises:

a corrugate tube (31) formed below a side surface of the pump inner body (30) to be inwardly folded while the elastic member (50) is compressed, and having a lower side surface extension piece (34) integrally formed at an outside of a lower end thereof;

a pump upper body coupling piece (32) having a substantially cylindrical shape on an upper portion of the pump inner body (30); and an upper side surface extension piece (33) extending from an outer side of an upper end of the pump upper body coupling piece (32), wherein the pump upper body coupling piece (32) and the upper side surface extension piece (33) of the pump inner body (30) are coupled to be interposed between first and second coupling extension pieces (28 and 29) of a pump upper body (20), wherein the first coupling extension piece (28) of the pump upper body (20) is coupled to make contact with an upper portion of a horizontal connection piece (35) of the pump inner body (30) such that the first coupling extension piece (28) is pressed, wherein a valve protrusion wheel (41) of the discharge valve (40) is coupled to be covered by a dispensing protrusion rod (24) of the pump upper body (20), and wherein a coupling protrusion wheel (42) of the dispensing valve (40) is coupled to a dispensing valve coupling space (22) of the pump upper body (20), wherein the dispensing valve (40) is positioned on a top surface of the pump upper body (20), wherein the elastic member (50) is installed from the upper side surface extension piece (33) to the lower side surface extension piece (34), wherein the pump inner body (30) is made of an elastic material, and wherein a horizontal distance of the pump inner body (30) is greater than a height of the pump inner body (30).

5. The contents dispensing pump of claim 1, wherein an inlet ring-type protrusion part (13) is formed on an outer side of the content inlet (12) of the pump main body (10).

6. The contents dispensing pump of claim 1, wherein the pump upper body (20) is provided on a central part of an upper body upper plate (21) thereof with a concaved dispensing valve coupling space (22).

7. The contents dispensing pump of claim 6, wherein the dispensing valve coupling space (22) is provided at a central portion thereof with the dispensing protrusion rod (24).

8. The contents dispensing pump of claim 6, further comprising protrusion pieces (25-1) formed on a side surface and a bottom surface of the dispensing valve coupling space (22) such that a path (46), which allows contents to flow through a space between the protrusion pieces (25-1), is formed.

9. The contents dispensing pump of claim 1, wherein the pump upper body (20) includes a first coupling extension piece (28) which is formed below an upper body upper plate (21) and is coupled to the pump inner body (30).

10. The contents dispensing pump of claim 1, wherein the pump upper body (20) further comprises a tension bar (21-1) extending from the upper body upper plate (21).

11. The contents dispensing pump of claim 1, further comprising the absorbing valve plate (70) formed on a bottom surface of the pump inner body (30).

12. The contents dispensing pump of claim 1, wherein an upper end of the pump upper body coupling piece (32) and an upper end of the corrugate tube (31) are integrally connected to the horizontal connection piece (35).

13. The contents dispensing pump of claim 12, wherein the horizontal connection piece (35) is formed to press a lower end of the first coupling extension piece (28) of the pump upper body (20).

14. The contents dispensing pump of claim 1, wherein the corrugate tube (31) is formed to be inwardly folded.

15. The contents dispensing pump of claim 1, wherein the pump inner body (30) includes at least one of general rubber, elastomer, silicon rubber, NBR rubber, and synthetic resin having excellent elasticity and including polyethylene (PE) and polypropylene (PP).

16. The contents dispensing pump of claim 1, wherein the dispensing valve (40) is coupled to an upper side of the pump upper body (20) and comprises a valve protrusion wheel (41) for opening or closing the content outlet (23) of the pump upper body (20).

17. The contents dispensing pump of claim 1, wherein the contents dispensing pump is used for a cosmetic cream container, a lotion container, a compact container, a daily supply container, a food container or a medicine container.

* * * * *